US008061065B2

(12) United States Patent
Shreider et al.

(10) Patent No.: US 8,061,065 B2
(45) Date of Patent: Nov. 22, 2011

(54) APPARATUS AND A METHOD FOR CONSTRUCTING AN UNDERGROUND CONTINUOUS FILLING WALL AND STRATUM

(76) Inventors: Vladimir Anatol Shreider, Sydney (AU); Natalia Shreider, Sydney (AU)

( * ) Notice: Subject to any disclaimer, the term of this patent is extended or adjusted under 35 U.S.C. 154(b) by 569 days.

(21) Appl. No.: 11/881,629

(22) Filed: Jul. 30, 2007

(65) Prior Publication Data

US 2009/0031591 A1 Feb. 5, 2009

(51) Int. Cl.
*E02F 3/08* (2006.01)

(52) U.S. Cl. ..... 37/462; 37/465; 37/349; 37/352; 37/403; 37/449; 37/142.5; 405/267; 405/271; 405/287; 405/233

(58) Field of Classification Search ..... 37/462, 37/465, 349, 352, 353, 355, 403, 449, 195, 37/357, 142.5; 405/267, 270, 271, 266, 286, 405/287, 287.1, 233, 236, 240–242
See application file for complete search history.

(56) References Cited

U.S. PATENT DOCUMENTS

| | | | | | |
|---|---|---|---|---|---|
| 3,645,101 | A * | 2/1972 | Sherard | 405/267 |
| 3,893,302 | A * | 7/1975 | Peterson | 405/267 |
| 4,681,483 | A * | 7/1987 | Camilleri | 405/267 |
| 5,112,161 | A * | 5/1992 | Trevisani | 405/267 |
| 5,244,315 | A * | 9/1993 | Kitanaka et al. | 405/267 |
| RE34,576 | E * | 4/1994 | Camilleri | 405/267 |
| 5,349,765 | A * | 9/1994 | Kitanaka et al. | 37/356 |
| 5,639,182 | A * | 6/1997 | Paris | 405/128.5 |
| 5,685,668 | A * | 11/1997 | Justice | 405/267 |
| 5,788,422 | A * | 8/1998 | Gardner et al. | 405/267 |
| 5,791,825 | A * | 8/1998 | Gardner et al. | 405/267 |
| 6,059,447 | A * | 5/2000 | Paris | 366/271 |
| 6,139,225 | A * | 10/2000 | Koike et al. | 405/267 |
| 6,574,893 | B2 * | 6/2003 | Mizutani | 37/462 |
| 7,481,604 | B2 * | 1/2009 | Perpezat et al. | 405/267 |
| 2004/0208710 | A1 * | 10/2004 | Shreider et al. | 405/267 |

* cited by examiner

*Primary Examiner* — Thomas Beach
*Assistant Examiner* — Matthew Buck

(57) ABSTRACT

A number of slot filling-compressing members are inserted from a framework into and across a slot-shaped excavation at ahead of a frontal face of a continuous, compacted slot filling being formed along the slot, and moved with a drive means connected to the members for intermittently forcing portions of the members against the filling to compress the filling adjacent to the members longitudinally against the face. The compacted filling is in this way formed by longitudinal pressure. The members can be mounted for forward or reciprocating movement in directions along and across the face.

20 Claims, 14 Drawing Sheets

3
5
2A
11
9
8
14
6
H
4
J
15c
12
15a
13
7a
13
18
14
18
8
7b
7
15
3
3
A
A
17
16
7a
7b
13d
12
13a
L
16
13a
15a
7a
13
17
7b
16
1A
13
18
13a
J
13
K
13a
17
13c
13b
K
7a
16
15a
18
1A1
14a
10
M
K
J
13
15b 3
5
2B
11
9
8
14
7
6
4
H
19
15a
B
I
7
15c
18
13
7a
19a
J
19d
16
7b
15a
19c
1B1
1B
K
20
L
M
14a
15b
10

O
14
B
1B
K
H
15c
A
1A
1Ai
1Bi
15
3
4
N
ABCDEFG

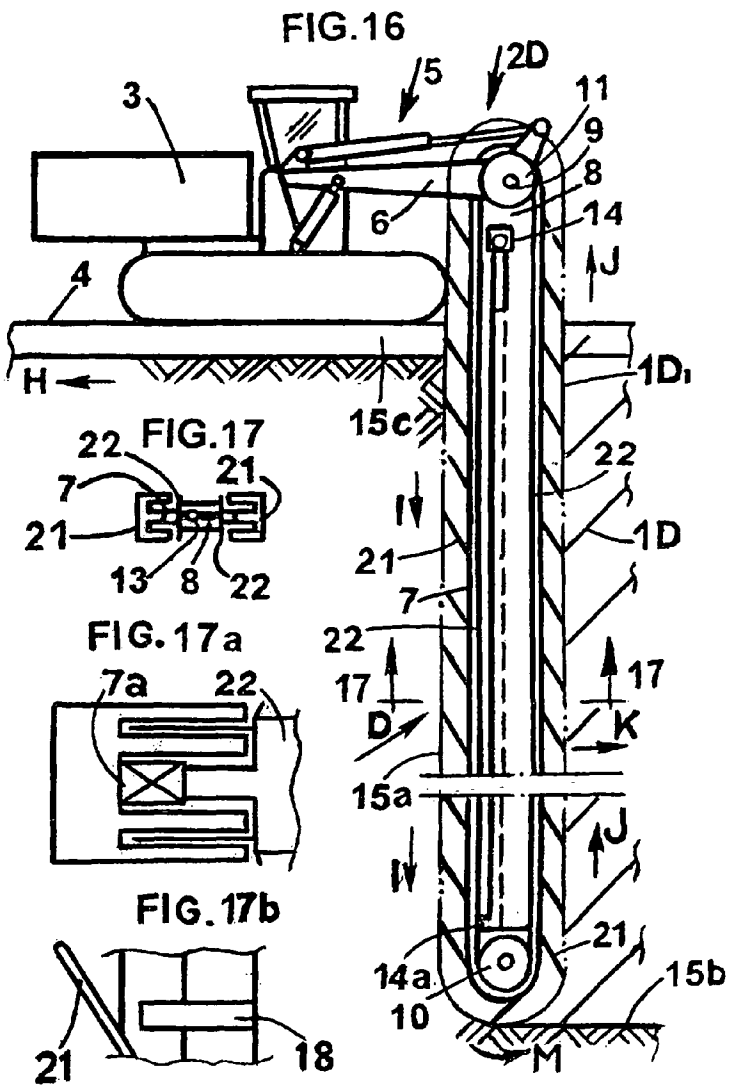
FIG.16
FIG.17
FIG.17a
FIG.17b
2D
5
3
4
H
6
11
9
8
14
J
1D₁
22
1D
17
K
15c
21
7
D
15a
I
14a
10
15b
M
13
18
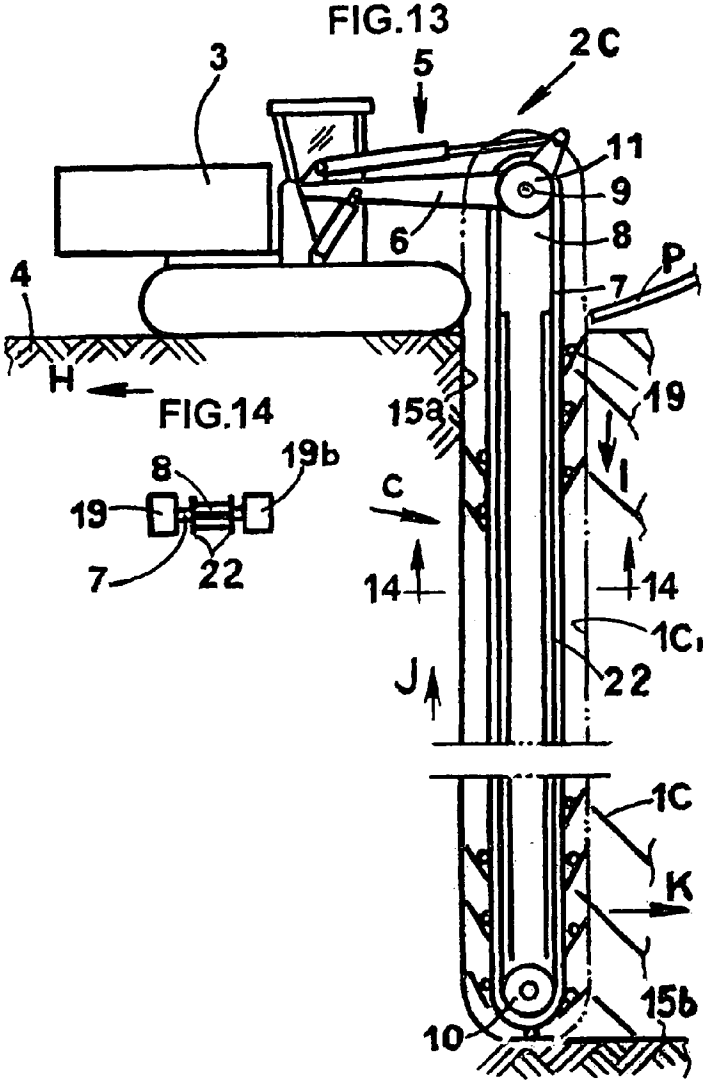
FIG.13
FIG.14
2C
5
3
4
H
6
11
9
8
7
P
19
I
14
1C₁
22
15a
C
J
1C
K
15b
10
19b
19

3
4
5
6
2E
24
25
32
35
H
K
29
33
29a
23
23a
E
28
1E
29b
J
31
22
34
29c
29d
26
27
30
28a
15
1E
29

2G
1G
3
4
5
6
53
54
55
56
57
58
59
59a
59b
60
61
62
63
64
65
66
67
68
69
70
71
72
73
15b
G
H
J
K 102S
102T
107e
104a
105
106
108
103
4
115
K
J
I
101S1
104
104b
114
S1
T1
107
H
39
101T1
104c
S
102T
T
45
124
125
127
126
129
132
104d
126a
104c
101T1
128
130
131
116
114a 117
133
S2
T2
U2
101S2
101T2
101U2
114
126
S1
T1
U1
V1
101U1
101T1
101S1
103
104a
103A
101U
101T
125
124
4
H
I
J
K
L
O
P
R
S
T
U
N

APPARATUS AND A METHOD FOR CONSTRUCTING AN UNDERGROUND CONTINUOUS FILLING WALL AND STRATUM

CROSS-REFERENCE TO RELATED APPLICATIONS

This application is instead of an application Ser. No. 11/796,149, filed on Apr. 27, 2007 as 371(c) date because partly lost when being sent and now cancelled.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention relates to apparatuses for excavating ground and constructing underground continuous, draining and retaining vertical wall- and horizontal stratum-shaped structures of a hardening liquid-excavated ground mixture or ready-mixed concrete or sand, especially to control a ground gas and water flow and to provide a drainage, isolation, containment and separation of subsurface environments, prevention of a leakage through levees and isolation of contaminated and sensitive areas, as anchors and foundations, and to underground continuous wall-shaped structure construction methods utilizing the apparatuses in civil engineering and construction works.

In constructing an underground wall according to a prior art technique, first a hole of an elliptical cross-section having a 2 to 3 m major axis is dug in the ground to a predetermined depth by a powerful bucket or by two or three series of auger drills. After the hole formed in slurry is sealed with a bentonite solution to prevent further penetration of slurry, a reinforcing bar cage is placed in the groove and a ready mixed concrete is then poured into the groove to form a foundation column. Such method is repeated to form an underground continuous wall. Slurry or bentonite solution layers interrupt the formation of the continuous wall so that after completion of the wall, ground water tends to leak into the inside of the continuous walls through the joints. It is therefore very difficult to provide the underground continuous wall simultaneously having two functions as foundation wall and a diaphragm wall.

U.S. Pat. No. 5,244,315 discloses an apparatus for constructing an underground continuous wall that includes a travelling trolley, supporting frames, an endless chain cutter and agitator. The cutter excavates a trench, jets a hardening liquid in an excavated groove and mixes the liquid with the earth and sand in the groove to form a soil cement wall. Significant defects of the apparatus and method of its advancement are: it is very difficult to form a deep wall in the stony ground and a horizontal stratum; the cantilever endless chain cutter being advanced that requires a huge traction force and stabilizing moment applied to the trolley; the cutter is not capable to compact the filling wall being formed and for forming a compacted running filling there is needed much more hardening liquid.

U.S. Pat. No. 5,685,668 for Barrier Wall Installation System discloses an apparatus for delivering an unrolling liner material into and along a trench being formed of a depth up to sixty feet that prevents side wall collapse in a subsurface water saturated zone and forms a barrier wall. Significant defects of that barrier wall installation system are the similar as shown above and following: the wall may be shaped into plane and vertical cylindrical surfaces only because of the cylindrical shape of a roll of the liner material; it is difficult to use a wide liner material of a width that is sufficient to reach a first confining bed.

BRIEF SUMMARY OF THE INVENTION

It is, therefore, an object of the invention to provide more efficient apparatuses such as an apparatus for constructing an underground, substantially smoothly continuous, multifunction compacted filling structure such as a vertical preferably drain, diaphragm, anchor and foundation wall and a horizontal preferably drain and diaphragm stratum and the like that being formed in the ground in a broadened field of use and in simple processes in a shorter construction period.

It is another object of the invention to provide construction methods for constructing the underground filling walls and stratums, which methods are able easily and rapidly construct the underground continuous stratum and wall without joints and without any risk of leakage of ground water with the use of the apparatuses.

In order to accomplish the first object, there is a number of preferable embodiments of the apparatus for constructing the underground continuous and compacted filling walls and stratums according to the invention, each of the embodiments comprises a chassis supporting a means for forming the structure, the chassis being movable along the length of a structure line in an intended advancing direction over the ground to produce the structure which extends in that direction in an excavated section, the forming means is adapted to be inserted into the ground from a supporting framework on the chassis and comprises a means for making excavated sections, a means for filling the sections with filler materials, a number of filling-compressing members, the members being displaceable in intended compressing directions, the framework adapted to connect the chassis to the forming means and to dispose and advance the forming means in the advancing direction to produce the structure, a means supporting and guiding the forming means on the framework for displacement in the compressing directions, a drive means for producing relative movement between the framework and each of the number of the members to effect advancement of the structure, so that a filling-compressing portion of each of the members alternately compacts and retreats from a front working face of the filling as the framework is transported in the advancing direction.

In the firstly preferred feature of the invention, the forming means is an endless cutter comprising a longitudinally displaceable, elongate, endless member and a number of cutter members and the number of the compressor members alternately arranged on the endless member, each of the compressor members is shaped into a slider and the compressing portion is shaped into a slider facet positioned at a back angle, the angle being equal to about 20-30° in relation to the compressing direction depending on the cohesion and the angle of friction of the compressed filling on the slider facet, and is operable to displace the filling in a direction toward the face, the drive means capable of effecting relative movement between the framework and the endless member to effect advancement of the structure.

Moreover, each of the sliders being supported pivotally about a generally horizontal axis which being within the pivoting slider and the endless member and perpendicular to a central surface of the endless member, between a front compressing position ahead of, in relation to the advancing direction, and below the endless member and a rear compacting position at behind the endless member, the front and rear positions being secured by edges of the pivoting slider and by limit stops of the endless member, and having the opposite pivoting facet portions operable by a return spring arranged between the endless member and the pivoting slider and capable of forcing the slider to pivot into the compacting position and against the face.

Furthermore, the endless cutter comprises a vertically-disposed, elongate partition member extending from the framework inside and toward a lower portion of the endless member and being engaged with side walls of the section being formed and the sliders for relatively closing off the interiors of the section ahead of and at the face behind the partition member, in relation to the advancing direction, to secure compression of the filling on the lower portion of the face.

Another object of the invention is the provision of an improved trench-forming screw cutter comprising the number of the compressor members shaped into elongate, disposed co-axially, in relation to a central axis, similar in construction, screw spiral blades capable to be provided on their outer screw edges with a plurality of cutter bits to form the screw cutter, supported for rotation about the central axis in a direction opposite to the screw spiral and have inner screw edges and the screw spiral slider facet portions disposed at an angle of helix, the angle of helix is equal to about 10-15°, oriented downward and outward and having an axial cross-section inclined at the back angle in relation to the central axis and operable to displace the filling in the downward and outward directions, and the drive means capable of rotating the screw blades which generate an injection channel extending down from the ground surface and opening radially between adjacent coils and at the lower ends of the blades, thereby compressing the filling toward a bottom of the section and the face.

Next object of the invention is the provision of an improved trench-forming wing cutter having a cutter and compressor member shaped into a vertically disposed, elongate wing blade supported for rotation about its generally vertical central axis and having outer edges, diagonally opposite portions between the edges have a mirror symmetrical, in relation to the central axis, equiangular for the back angle, spiral cross-section and operable to displace the filling in outward radial directions, the drive means is capable of rotating the wing blade in a direction opposite the spiral, whereby the wing blade generates an injection channel extending from the surface of the ground toward the lower end of the blade and opening oppositely and radially within the length of the blade.

Further object of the invention is the provision of an improved trench-forming cutter comprising a longitudinally displaceable elongate injection pipe adapted to extend down into the excavated section from the framework, the number of the members are arranged on the pipe, each of the number of the portions is shaped into a number of gabble roof salients having a vertex oriented backward, in relation to the advancing direction, and toward the face, the pipe has orifices opening between the adjacent salients, the drive means is capable of producing relative longitudinal reciprocation between the framework and the pipe, so that opposite slopes of the salients alternately form gaps between the back slopes of the salients and the face to suck a filler material from the pipe into the gaps to form the filling and compress the filling in the gaps toward the face to form and compact the face.

Moreover, the making means comprises a longitudinally displaceable elongate injection pipe for guiding and supporting components of the making means that adapted to extend down into the ground from the framework and having branched lower ends opening at a bottom of the section and a number of cutter blades arranged on the injection pipe to form a saw cutter, and the supporting means allows longitudinal, upward and downward reciprocation of the saw cutter and alternating downward and upward oscillation of each of the blades about a generally horizontal axis within the blade and the pipe, the axis being perpendicular to the central longitudinal surface of the pipe, and the drive means is capable of effecting the alternating downward and upward oscillation of each of the blades about the generally horizontal axis with the pipe, so that a forward oriented edge of each of the blades excavates the ground and opposite facet portions of the blade alternately compresses and retreats from the excavated ground located above the blade toward the surface of the ground and passes by the excavated ground located below the blade and being removed as the framework is transported in the advancing direction.

Further object of the invention is the provision of an improved forming means comprising a number of longitudinally displaceable elongate injection pipes shaped into a circular sickle and adapted to extend down from the framework, a number of cutter members of the making means and the number of the compressor members alternately arranged on the number of the pipes to form a sickle cutter, a number of inner and outer, in relation to the center of curvature of the sickle cutter, circular arc-shaped, excavation section-directing members fixed on corresponding inner and outer ends of the number of the cutter members and capable to force the number of the sickle pipes from their position toward the intended circular direction of reciprocation and control the direction of the advancement of the circular arc-shaped excavation sections and capable of being forced into interaction with fixed objects located on each side of the sickle cutter disposed horizontally in a starting operative position on the ground to urge the sickle cutter in a direction crossing the central longitudinal axis of the excavated section toward the intended circular direction of reciprocation, and have corresponding inward and outward oriented, in relation to the center of curvature, sections-directing portions for forcing the corresponding inner and outer object and an inner and outer side wall of the section being formed in the crossing direction, where the directing portions are operable to move the sickle cutter, with the directing members relatively to the objects and the side walls being forced toward the circular compressing directions by the drive means capable of forcing the directing portions against the objects and the side walls.

Still moreover, the apparatus further comprises a second chassis for supporting the forming means, the second chassis being movable along the length of a second structure line in a second intended advancing direction over the ground to produce the structure which extends in these first and second advancing directions in an excavated section, a second supporting framework adapted to be transported with the second chassis in the second advancing direction to produce the structure, a second means supporting and guiding the forming means on the second framework for displacement in the compressing directions, and the forming means comprises a number of injection pipes shaped into a sweep and the numbers of the cutter members and the compressor members arranged alternately on the sweep pipes to form a sweep cutter and extending between its opposite ends, second ends of the sweep pipes being over the ground and connected to the second supporting and guiding means to produce a hemioval trough-shaped excavation and the structure which extends in the advancing directions, and a second drive means on the second chassis for producing the longitudinal reciprocation in accordance with the first drive means, and a means for measuring a position of the second supporting and guiding means in relation to a position of the first supporting and guiding means, and a means for measuring positions of the first drive means and the second drive means and determining when to operate multiple activating means of the apparatus to effect further advancement of the excavation and the structure.

Next object of the invention is an improved apparatus comprising a compressor member shaped into an elongate shield adapted to extend from the framework down into and across the excavated section and provided with a sealing means on its side edges for engaging on side walls of the section to close off the face of a filling being formed in the section at behind the shield in relation to the interior of the section and prevent the loss of the filling from the face; the supporting and guiding means is supporting the shield on the framework for alternating forward and backward, in relation to the advancing direction, oscillation about a generally horizontal axis within the shield and the drive means is capable of producing alternating forward and backward oscillation of the shield about the generally horizontal axis.

Moreover, the framework comprises a tiltable upper frame arranged on the chassis and the endless cutter has a tiltable guide frame pivoted at its portion to the upper frame, a driving wheel and a number of guiding and supporting sprocket rotatably connected to the guide frame, an endless member extending around the sprockets and the driving wheel, and a number of cutter members arranged on the endless member, the guide frame has an underground portion extending down within the endless member and backward, in relation to the advancing direction, from inside the endless member toward aside of the cutter members and the shield and the supporting means supports the shield on the underground portion for alternating backward and forward oscillation about a generally horizontal axis within the shield, a central longitudinal plane of the shield being crossing a central longitudinal plane of the endless cutter at an acute angle, the angle being equal to about 88-89°, and each of the cutter members is capable of being forced into interaction with a facial wall of the excavated section being formed to urge the endless cutter in a direction crossing the planes toward the intended advancing direction.

In another modification according to the invention, a known endless chain cutter comprises an elongate guide post, a chain sprocket rotatably connected to a lower end of the guide post, an endless chain extending around the chain sprocket and a number of cutter members arranged on the endless chain to form an endless chain cutter, and the shield is pivoted at its upper portion to the framework and the forming means comprises a shield-supporting cam wheel that being supported on an underground portion of the guide post for rotation about a generally horizontal cam pivotal axis, the cam pivotal axis being perpendicular to the central longitudinal plane of the cutter, connected cinematically to the chain and capable of being forced into interaction with an underground portion of the shield to support mutually the underground portions of the guide post and the shield and having a number of shield-supporting and agitating radial cam portions having predetermined lengths from the cam pivotal axis and the ability to extend aside and past the chain and between the cutter members toward the underground portion of the shield; a number of forward oriented, cam portions-supporting wheels are connected to the underground portion of the shield rotatably about generally horizontal wheel pivotal axes which being perpendicular to the central longitudinal plane of the shield; where the cam portions are operable to support mutually and continuously and move the shield, with the supporting wheels, relatively to the cutter about the shield pivotal axis by the drive means capable of moving the chain relatively to the guide post and rotate the cam wheels about the cam pivotal axis and the shield wheels about the wheel pivotal axes to effect continuous supporting the face by the underground portion of the cutter, and alternating backward and forward oscillation of the shield about the shield pivotal axis to effect compaction of the face as the endless chain cutter is transported.

In further modification, the shield is disposed at an acute front angle, in relation to a bottom of the excavated section being formed, the angle being equal to about 55-65°, and the supporting means is shaped into a tail means for compressing the face, the tail means is movable along the bottom in the advancing direction and connected to a lower end of the shield for relative reciprocation in the compressing directions crossing remotely the shield pivotal axis, and the drive means is capable of producing relative reciprocation between the shield and the tail means to effect compaction of the face and the bottom.

In order to accomplish the second object, in the underground continuous wall and stratum construction method using the apparatus described above, the method according to the invention comprises steps of advancing a movable chassis along an excavation line by an activating means of an apparatus for constructing the structure and inserting a means for making the excavation, the means for making being part of a means for forming the underground structure, at a working position into the ground to a predetermined depth in the excavation and in an intended advancing direction so that the means for making forms a section of the excavation along the excavation line, introducing a filler material into the excavated section to form a filling of the introduced filler material within the section, inserting into the section and moving a means for compressing the filling, the means for compressing being part of the means for forming, in a working position in a compressing direction by an activating means of the apparatus to move the filling toward a frontal working face of a compacted filling structure being formed in the section and compress on the face to form the compacted filling structure.

Moreover, the method further comprising the steps of digging an upper, ditch-shaped section of the excavation along the line to a predetermined depth and width in the ditch section by means of an excavating device, inserting the making means into the ditch section and excavating the ground, while inserting an injection pipe into the excavated section to introduce an improving filler material in the section, whereby mixing and compressing a filling of the excavated ground and the introduced material within the section by the making means and the compressing means and their activating means toward a frontal working face of a compacted improved ground filling to form and compact the face and into the ditch section to form a head of the improved ground filling and the improved and compacted ground filling structure.

Furthermore, the method comprises the steps of inserting a partition member which being part of the forming means, into the excavated section between the making means and the compressing means, introducing an improving filler material in the section ahead of the partition member, mixing a filling of the material and the excavated ground in the section ahead of the partition member and moving toward and under a lower end of the partition member and compressing on a lower portion of a frontal working face of a compacted improved ground filling structure being formed to form the compacted improved ground filling structure from its lower portion.

The method further comprising the steps of removing the excavated ground, inserting an injection pipe, the injection pipe being part of the forming means, to jet a ready filler material into the excavated section between the compressing means and the face, filling the section between the compressing means and the face with the ready filler material to form a ready filling, moving the compressing means by the activating means against the face of the ready filling, thereby compressing the face to form a compacted ready filling structure.

A second method for continuous advancement of a section of a slot-shaped excavation in the ground that using the apparatus according to the invention comprises steps of operating an activating means of an apparatus for constructing the excavation, which advances two movable chassises along two excavation lines and inserts a means for making the excavation, the means for making being part of a means for forming the underground structure, at a working position into the ground to a predetermined depth in the excavation and in intended and determined advancing directions, so that the means for making forms the section of the excavation between the lines and materials of the structure to be let into the excavated section, and remotely exploring positions of the chassises and positions of a drive means on the chassises by a well-known suitable measuring means to determine when to operate the multiple activating means to effect further advancement of the section.

BRIEF DESCRIPTION OF THE SEVERAL VIEWS OF THE DRAWINGS

FIG. 13 is a side view of a third preferred embodiment of the apparatus according to the invention;

FIG. 14 is a cross-sectional view taken on line 14-14 of FIG. 13 of the endless chain cutter of the apparatus shown in FIG. 13;

FIG. 16 is a side view of a fourth preferred embodiment of the apparatus according to the invention;

FIGS. 17, 17*a* and 17*b* are a cross-sectional taken on line 17-17, from below and side views partly on a slightly enlarged scale of one example of a compressor slider used in the endless chain cutter of the apparatus shown in FIG. 16 according to the invention, respectively;

DETAILED DESCRIPTION OF THE INVENTION

Figures 1, 2, 3, 4A, 4B, 4C, 4D:
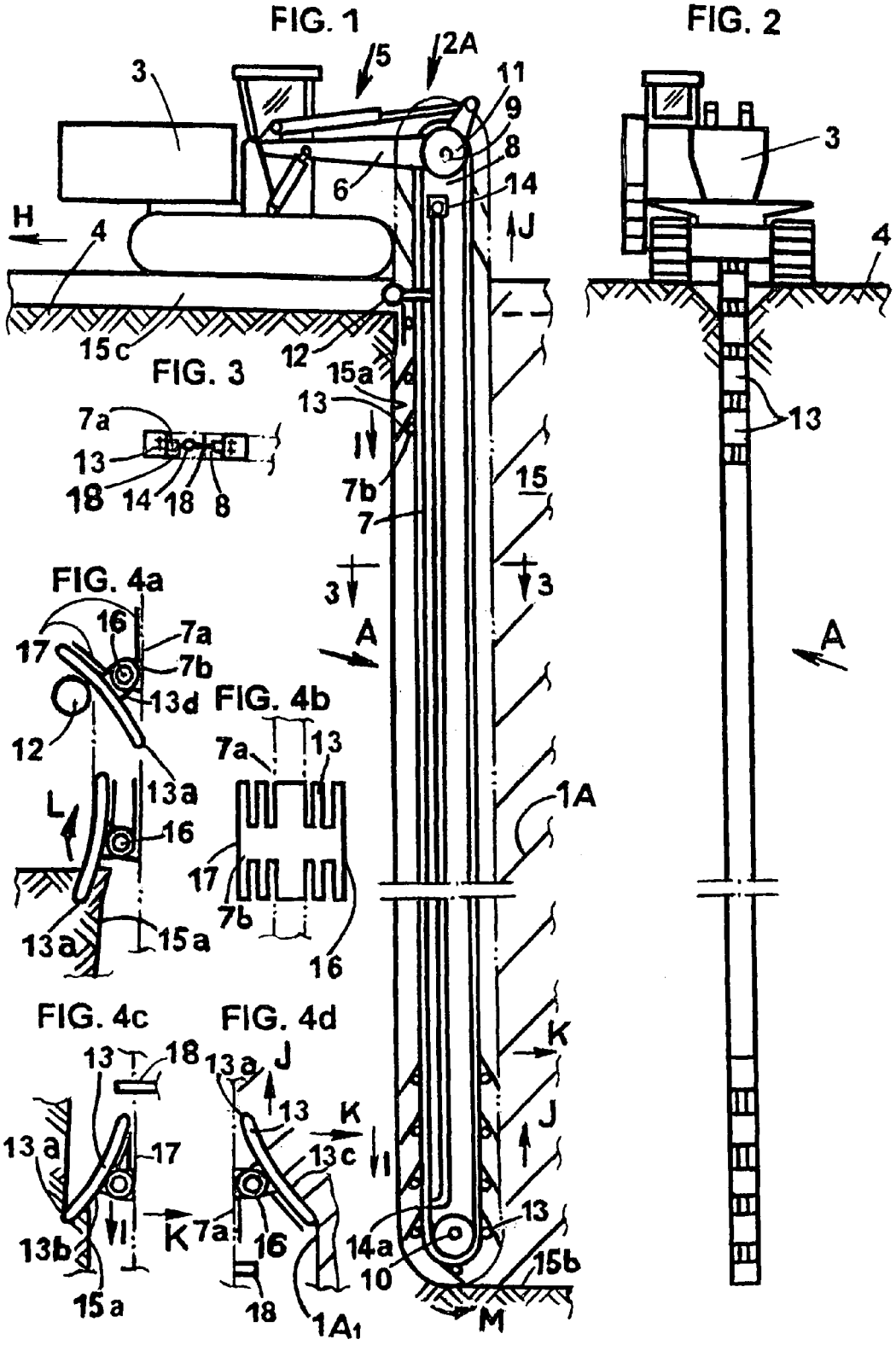
FIG. 1 is a side view of a first preferred embodiment of the apparatus according to the invention.
FIG. 2 is a view from the rear of the apparatus shown in FIG. 1.
FIG. 3 is a cross-sectional view taken on line 3-3 of FIG. 1 of the endless chain cutter of the apparatus shown in FIGS. 1 and 2.
FIGS. 4*a*, 4*b*, 4*c* and 4*d* are side view at turning from a rear compressing position into a frontal compressing position, from the rear, side in the frontal position and in the rear position views on a slightly enlarged scale relative to the FIGS. 1 to 3 of one example of compressor sliders used in the endless chain cutter of the apparatus shown in FIGS. 1 to 3, respectively.

In the describing of the preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

An underground continuous compacted filling structure such as a horizontally extending vertical preferably wall and a horizontal preferably stratum that is constructed with the aid of the apparatus depicted in the drawings embodying the teachings of the subject invention. Each of later described and illustrated embodiments of the constructing apparatus has a means for compressing a frontal working face of the filling structure to form the compacted filling structure. Each of later described and illustrated modifications of the compressing means is able to force a filling from its position in an excavated section to the face of the structure being formed at behind the apparatus to form the face and force the face in a crossing direction opposite an intended advancing direction to compact the face being formed to form a compacted filling structure according to the invention.

FIGS. 1 throughout 35 depict embodiments 2A throughout 2G of an apparatus 2 using modifications A throughout G according to the invention of a generally endless chain cutter for constructing varieties 1A throughout 1G of an underground continuous, compacted filling wall 1 and methods of construction of the wall and stratum 1 that according to the invention and using the embodiments 2A-2G.

The embodiment 2A as shown in FIGS. 1 and 2 comprises a traveling chassis 3 for transporting an endless chain cutter A for forming the wall 1A and supplying power and a filler material to the cutter A, the chassis 3 being movable on the ground 4 in an intended advancing direction shown by an arrow H in FIG. 1 along the length of a structure line, a supporting framework 5 mounted on the chassis 3 and adapted to be transported in the direction H over the ground 4 to connect the chassis 3 to the endless chain cutter A and to dispose and advance the cutter A in the direction H and comprising an upper tiltable frame 6 connected at its frontal portion to the chassis 3 with a known lifting, supporting and guiding means (not shown) and a lower tiltable frame (later described) pivoted at its portion to the frame 6 and adapted for supporting and guiding components of an endless cutter such as the cutter A, an endless member such as chain 7 displaceable longitudinally in directions shown by an arrow I in FIGS. 1, 4*a* and 4*c* and by an arrow J shown in FIGS. 1 and 4*d*, a lower tiltable, elongate, disposed vertically preferably, endless chain-guiding and supporting frame or post 8 as shown in FIGS. 1 and 2 and having a central longitudinal surface, substantially similar in shape to a cross-section of a central longitudinal surface of the wall 1A which is to be formed; a known saddle (not shown) slideably arranged on rails (not shown) disposed longitudinally on the guide post 8 and adapted to be driven relative to the guide post 8 by a drive means (not shown); a hydraulic preferably drive means such as power hydraulic motor 9 provided preferably on the guide post 8 and having an output shaft (not shown); a chain sprocket 10 supported rotatably on a lower end of the guide post 8; a chain driving wheel 11 supported rotationally to the saddle and connected to the shaft for driving the chain 7 extending around the chain sprocket 10 and the chain wheel 11; a baffle member 12 which is supported by and at ahead of the guide post 8 for guiding a number of cutter and compressor sliders 13 arranged on the chain 7 to form an endless chain cutter A; an injection pipe 14 for jetting a running, excavated ground-improving material such as lubricating water or sealing clay fluid or hardening cement milk into the sections that extending, from the frame 6 into the guide post 8 and having orifices 14*a* opening at intended locations along the length of an underground portion, preferably at a lower end of the guide post 8.

One example of arrangement of the cutter and compressor sliders 13 is shown in FIGS. 1, 2, 3, 4*a*, 4*b*, 4*c* and 4*d*. Each of the sliders 13 has a cutting edge 13*a* oriented alternately downward in the direction I for excavating the ground 4 from a working facial wall 15*a* of the excavated section 15 to advance the section 15 and form a filling of the excavated ground in the section 15 and in the direction J for further scraping the filling of the excavated ground at behind the guide post 8; a backward oriented, in relation to the advancing direction H and in a direction shown by an arrow K in FIGS. 1, 4*c* and 4*d* compressing slider facet portion 13*b* as shown in FIG. 4*c* that is oriented at a back angle relative to the direction I when being ahead of the guide post 8, where the back angle is equal to about 25-30°, preferably 30° depending on the cohesion and the friction angle of the compressed filling on the portion 13*b* and capable of forcing the filling of the excavated ground from its position ahead of the guide post 8 in a direction shown by an arrow K in FIGS. 1, 4*c* and 4*d* past and to behind the guide post 8 to form the face $1A_1$; and a facial slider facet portion 13*c* as shown in FIG. 4*d* oriented at the back angle in relation to the direction J when being at behind the guide post 8 and capable of further forcing the excavated ground in the direction K and compressing on the face $A_1$ thereof; a number of bearing lug portions 13*d* distributed transversally within the portion 13*c*, preferably in its middle, and extended toward a support chain link 7*a* of the chain 7 as shown in FIGS. 4*a* to 4*d* and connected to a number of co-axial bearing lug portions 7*b* of the link 7*a* extended transversally and toward the slider 13 by means of an elongated bearing part such as a slider pivotal pin 16 permitting oscillation of the slider 13 about a generally horizontal pivotal axis of the pin 16 relative to the chain 7, where the slider pivotal axis being perpendicular to the central longitudinal surface of the cutter A, between limit stops (not shown) such as edge portions of the chain-links 7*a* and between a ground-cutting and filling of the excavated ground-compressing operative position ahead of the guide post 8 as shown in FIG. 4*c*, where the slider 13 being displaced in the direction I, and a filling of the excavated ground-compressing and face $1A_1$-forming and compressing operative position at behind the guide post 8 as shown in FIG. 4*d*, where the slider 13 being displaced in the direction J; a spiral screw return spring 17 placed co-axially on the pin 16 and fixed with its distant ends to the chain link 7*a* and to the slider 13. The slider pivotal connection and the spring 17 permit the slider 13 when it being forced into interaction with the baffle rod 12 as shown in FIG. 4*a* to be turned about the axis of the pin 16 from a first limit stop and the compressing operative position remaining over the ground 4 and represented in FIGS. 4*d* and 4*a* in a direction shown by an arrow L in FIG. 4*a* into an inoperative longitudinal position and then by aid of the resistance of the wall 15*a* to cutting which impeding the edge 13*a* located remotely from the axis of the pin 16 from the inoperative longitudinal position into the cutting and compressing operative position at a second limit stop shown in FIG. 4*c*.

Each of the sliders 13 can be shaped into an agitator comb as shown in FIG. 4*b*. A number of agitator bars 18 can be fixed on and perpendicularly to faces of the guide post 8 with the ability to pass through comb hollows of the sliders 13. The sliders 13 and the bars 18 being capable of agitating the filling of the excavated ground and the improving material being injected through the injection pipe 14 to mix them together.

As seen in FIG. 4*a*, each of the sliders 13 is caused to move with the endless chain 7 from the driving wheel 11 above the ground 4 in the direction I and forced into interaction with the baffle rod 12 remotely from the pivotal axis of the pin 16 so that the rod 16 and the chain 7 with the driving wheel 11 are capable to turn the moving slider 13 about the axis of the pin 16 from the compressing operative position so as shown in FIGS. 4*d* and 4*a* against the resistance of the return spring 17 in the direction L into the cutting and compressing operative position so as shown in FIGS. 4*a*, 4*b* and 4*c*. When the sharpened edge 13*a* of the slider 13 moves in the direction I, a trench section 15 will form as the ground 4 is excavated from the wall 15*a* and a trench filling of the excavated ground will form as the excavated ground is loosened and agitated to be mixed with the improving material which being injected through the injection pipe 14.

As the portion 13*b* of the slider 13 which being in the cutting and compressing position at the back angle that moves in the direction I, the structure face $1A_1$ will be formed at behind closely the guide post 8 as the excavated ground and the improving material are forced from their position at the wall 15*a* in the direction K past and to behind closely the guide post 8 and agitated by means of the sliders 13 and the bars 18 to be mixed and compressed toward the face $1A_1$. After the slider 13 is caused by the wall 15*a* to turn with the sprocket 10 and form a bottom 15*b* of the section 15, the spring 17 turns the unloaded slider 13 from the cutting position as shown in FIG. 4*c* in a direction shown by an arrow M in FIG. 1 relative to the chain 7 against the lesser resistance of a soft mixture of the excavated ground and the improving material into the compressing position shown in FIG. 4*d* and keeps the slider 13 in the latter. As the portion 13*c* of the slider 13 in the compressing position at the back angle in relation to and in the direction J as shown in FIG. 4*d* that moves closely at behind the guide post 8, the compacted filling wall 1A will form as the mixture of the excavated ground and the improving material on the portion 13*c* is agitated, forced in the direction K and compressed on the face $1A_1$.

The drive motor 9 with the sliders 13 can be used to assist the chassis 3 in moving up the guide post 8. The operations of forming an improved and compacted ground wall 1A in this way is carried out as part of an overall sequence involving the moving up of the cutter A.

Figures 5, 6, 7, 8A, 8B, 8C, 8D:
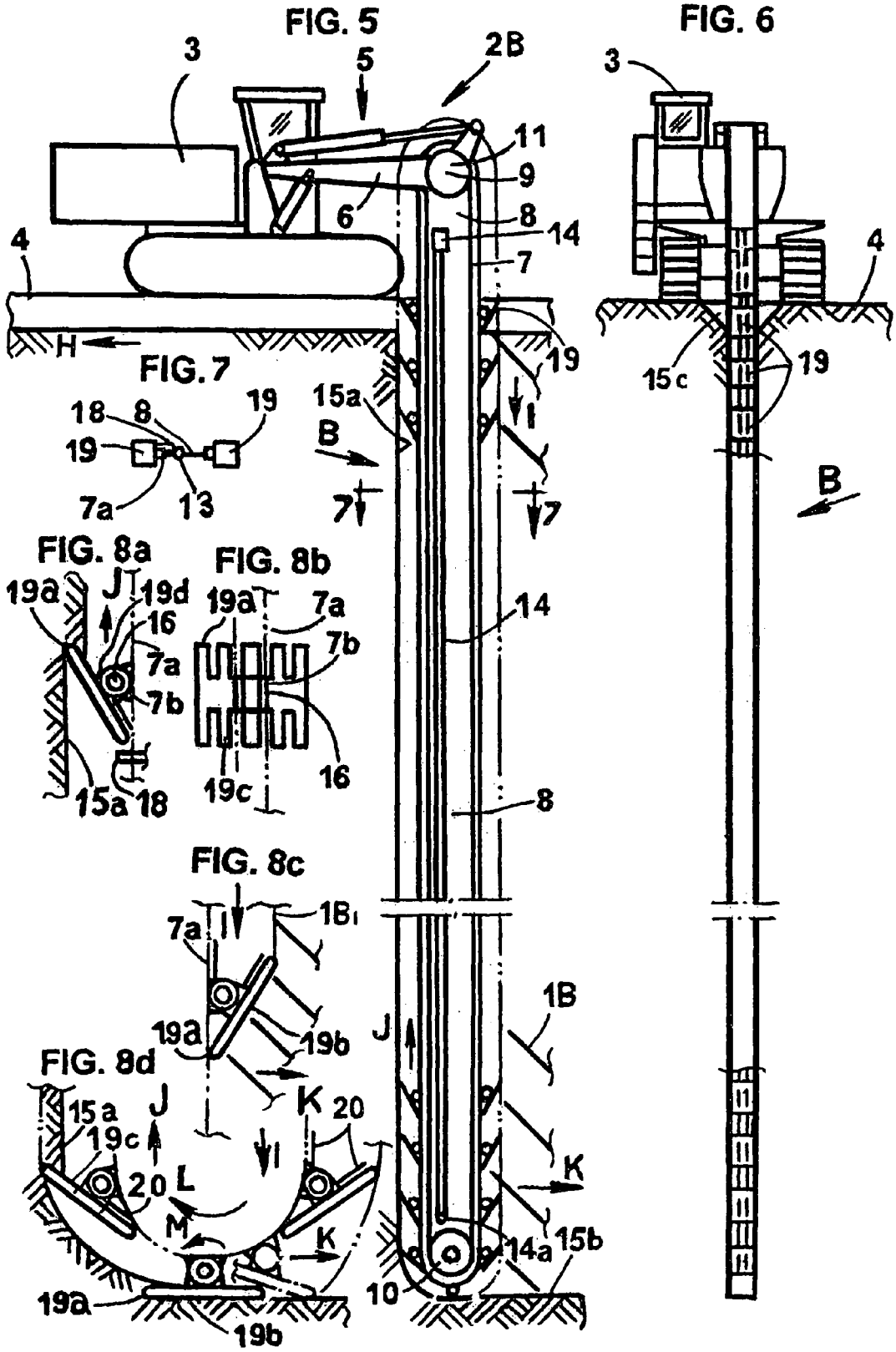
FIG. 5 is a side view of a second preferred embodiment of the apparatus according to the invention.
FIG. 6 is a view from the rear of the apparatus shown in FIG. 5.
FIG. 7 is a cross-sectional view taken on line 7-7 of the endless chain cutter of the apparatus shown in FIG. 5.
FIGS. 8*a*, 8*b*, 8*c* and 8*d* are side, from the rear in a frontal compressing operative position, side in a rear compressing operative position and at movement from the rear position into the frontal position views on a slightly increased scale relative to FIGS. 5 to 7 of one example of a compressor slider used in the endless chain cutter of the apparatus shown in FIGS. 5 to 7 according to the invention, respectively.

The embodiment 2B of the apparatus 2 as shown in FIGS. 5, 6, 7, 8*a*, 8*b*, 8*c* and 8*d* for constructing an underground continuous compacted ground wall 1B which is similar in filler materials to the wall 1A, that is preferably partly similar in construction to the apparatus 2A and comprises an endless chain cutter B which is similar partly in construction to the cutter A and comprises a number of ground 4-cutting, excavated ground- and wall face $1B_1$-compressing, cutter and compressor sliders 19 fixed to the chain 7 as shown in FIGS. 5 to 7 and 8*a* to 8*d* that are similar partly in construction to the sliders 13. A means for driving the sliders 19 comprises a spiral screw return spring 20 placed co-axially on the pin 16 and connected with one its distant end to the chain link 7*a* and with other its distant end to the slider 19 remotely from the axis of the pin 16 for producing the turning movement of the slider 19 about the axis of the pin 16, when the slider 19 being above the ground 4 and unloaded, from a ground 4-cutting and filling of the excavated ground-compressing, frontal operative position as shown in FIGS. 5 and 8*a* to 8*c* at ahead of the chain 7 and relative to a supporting chain link 7*a* as shown in FIGS. 8*a* and 8*b* in a direction shown by an arrow L in FIG. 8*d* between limit stops (not shown) into a rear, face $1B_1$-compressing operative position at behind closely the guide post 8 as shown in FIG. 8*c*. The spring 20 is capable of keeping the slider 19 in the face-compressing position against the resistance of the face 1B, and permits the turning of the slider 19 from the face-compressing position into the cutting and filling-compressing position.

One example of arrangements of the sliders 19 is shown in FIGS. 8*a*, 8*b*, 8*c* and 8*d*. Each of the sliders 19 has a sharpened cutting edge 19*a* for excavating the ground 4 in a direction shown by an arrow J in FIGS. 5, 8*a* and 8*d* and for scraping a filling of the excavated ground in the excavated section 15 in a direction shown by an arrow I in FIGS. 5 and 8*c* and a frontal compressing slider facet portion 19*b* as shown in FIGS. 8*c* and 8*d* capable of being oriented in the direction I and in a direction shown by an arrow K shown in FIG. 8*c* for forcing a mixture of the excavated ground and a running improving material in the direction K and compressing on the face $1B_1$, where the portion 19*b* being positioned in the face-compressing operative position at the back angle in relation to the direction I; an oriented in the directions J and K rear compressing slider facet portion 19*c* as shown in FIGS. 8*a*, 8*b* and 8*d* for forcing the excavated ground and the improving material in the direction K toward the face $1B_1$, where the portion 19*c* being positioned in a cutting and filling and filling-compressing operative position at the back angle in relation to the direction J. Each of the sliders 19 is shaped into an agitator comb as shown in FIG. 8*b*. A number of agitator bars 18 are fixed on and perpendicularly to faces of the guide post 8 with the ability to pass through comb hollows of the sliders 19. The sliders 19 and the bars 18 being capable of agitating the excavated ground and a running improving material being injected through the injection pipe 14 into the section 15 to mix them together.

In operation, each of the sliders 19 is capable of being forced into interaction with a frontal working facial wall 15*a* of an excavated section 15, excavate the ground 4 and filling the section 15 with the excavated ground in the section 15, forcing the excavated ground on the portions 19*b* and 19*c* in the direction K to the face $1B_1$ of the wall 1B being formed and compressing on the face $1B_1$. As each of the sliders 19 moves with the chain 7 in the direction J in FIGS. 5 and 8*a* by the drive means 9 and being kept in the cutting and compressing operative position as shown in FIGS. 5, 8*a* and 8*d* by the resistance of the wall 15*a* and against the resistance of the spring 20 and a limit stop such as an edge of an endless chain link 7*a*, the section 15 will be formed as the ground 4 is excavated from the wall 15*a*, and the section 15 will be filled with the excavated ground, and the ground wall 1B will be formed as the filling of the excavated ground is forced in the direction K past and to behind the guide post 8 and compressed on the face $1B_1$. When each of the sliders 19 comes to above the ground 4, the spring 20 forces the unloaded slider 19 to turn about the axis of the pin 16 from the first limit stop and the cutting and compressing position up to the second limit stop into the compacting position as shown in FIGS. 8*c* and 8*d* and urges the slider 19 to be kept in latter against the resistance of the soft face $1B_1$ before it has hardened. Then, as each of the sliders 19 moves in the direction I as shown in FIGS. 5 and 8*c*, the filling of the excavated ground on the slider 19 is scraped from at behind the guide post 8, forced in the direction K and compressed on the face $1B_1$. When each of the sliders 19 reaches the bottom 15*b* of the section 15 and is forced simultaneously by the endless chain 7 in the direction L in FIG. 8*d* and by the bottom 15*b* and then the wall 15*a* in a direction shown by an arrow M in FIG. 8*d*, the slider 19 will be turn about the axis of the pin 16 from the compacting position represented in FIGS. 5, 8*c* and 8*d* against the resistance of the spring 20 into the cutting and compressing position represented in FIGS. 5, 8*a* and 8*d* up to the limit stop. Thereafter, each of the sliders 19 is being kept in the cutting position by the drive motor 9, the wall 15*a* and the limit stop. A ground filling-improving material such as a hardening sealing clay fluid or a cement milk and the like can be injected through the injection pipe 14 in the section 15 to be agitated and mixed with the excavated ground by means of the sliders 19 and the bars 18 to form a compacted and improved ground wall 1B. The drive motor 9 with the sliders 19 can be used to assist the chassis 3 in moving up the guide post 8. The operations of compressing an improved ground filling to form a compressed improved ground wall 1B in this way is carried out as part of an overall sequence involving the movement of the cutter B.

Figures 9A, 9B, 10, 11, 12:
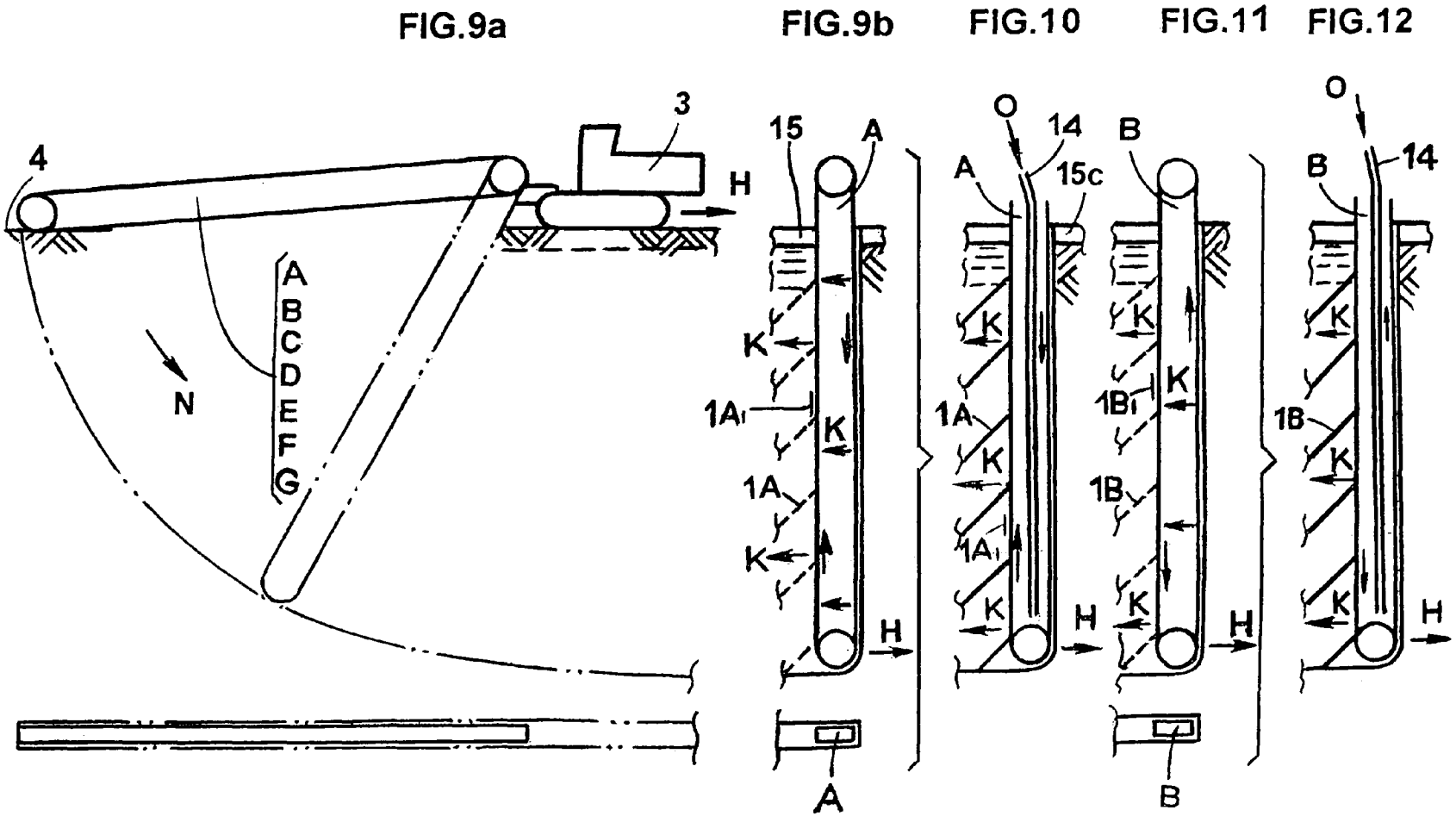
FIG. 9*a* is a view illustrating the process of the construction methods according to the invention with using the apparatuses shown in FIGS. 1 to 8, 13, 14, 16, 17, 20-22, 24-27, 29-34.
FIG. 9*b* is a view illustrating the processes of the first construction method according to the invention with using the apparatus shown in FIGS. 1 to 4*d;*
FIG. 10 is a view illustrating the processes of the second construction method according to the invention with using the apparatus shown in FIGS. 1 to 4*d;*
FIG. 11 is a view illustrating the processes of the first constructing method according to the invention with using the apparatus shown in FIGS. 5 to 8*d;*
FIG. 12 is a view illustrating the processes of the second construction method according to the invention with using the apparatus shown in FIGS. 5 to 8*d;*

In constructing an underground, continuous, compacted improved ground wall 1A or 1B by using the corresponding apparatus 2A or 2B constructed described above, the endless chain cutter A or the endless chain cutter B is assembled into the desired length and placed on the ground 4 as shown in FIG. 9*a* or in an excavated ditch section 15*c* shown in FIG. 6 that is dug previously in the ground 4 to predetermined depth and width in the section 15*c* where the wall 1A or 1B is to be formed by means of an excavating device such as a plough ditcher (not shown). Thereafter, the endless chain 7 of the endless chain cutter A or B is driven by means of the drive motor 9 in the intended directions I and J shown in FIGS. 1 and 5, the cutter A or B inserts into the section 15*c* and the ground 4 and tilts about the chassis 3 in a direction shown by an arrow N in FIG. 9*a* into an intended inclined up to about 60° relative to the horizontal plane or vertical preferably operative position as shown in FIGS. 1 and 5, while the chassis 3 is advanced in a direction shown by an arrow H in FIGS. 1 and 5 to form a continuous groove in the ground 4.

FIGS. 9*a* and 9*b* illustrate the first construction method according to the invention by the use of the endless chain cutter A and FIGS. 9*a* and 11 illustrate that first method by the use of the endless chain cutter B. First, an upper ditch section 15*c* of an excavated section 15 is dug in the ground 4 to a predetermined depth and width by means of an excavated device such as a known plough ditcher (not shown). The n cutter A of the apparatus 2A or the cutter B of the apparatus 2B is then inserted into the ditch section 15*c*. Thereafter the endless chain 7 is driven in the predetermined directions shown by arrows I and J in FIGS. 1 and 5 and the chassis 3 is driven in the predetermined direction shown by an arrow H in FIG. 9*a* to excavate the ground 4. As a result, a frontal working face $1A_1$ of a mixed ground filling or an improved mixed ground falling 1A that is compressed to form a compacted, mixed or improved ground wall 1A or 1B and a surplus portion of the ground filling is forced into the ditch section 15*c* to form a head of the compacted ground wall 1A or 1B. The drive means 9, the endless chain 7 and the sliders 13 or 19 of the apparatus 2A or 2B are capable of assisting the chassis 3 to advance up the guide post 8.

FIGS. 9*a*, 10 and 12 illustrate the second construction method according to the invention by the use of the apparatus 2A or the apparatus 2B. First, an upper ditch section 15*c* of an excavated section 15 is dug in the ground 4 to a predetermined depth and width in the section 15*c* by means of an excavating device (not shown) such as a plough ditcher and the like. The endless chain cutter A of the apparatus 2A or the endless chain cutter B of the apparatus 2B according to the invention is then inserted into the ditch section 15*c*. Thereafter the chassis 3 is driven in the predetermined direction shown by an arrow H and the endless chain 7 is driven in the predetermined direction shown by arrows I and J in FIGS. 10 and 12 to excavate the ground 4, while a running, excavated ground-improving material such as hardening cement milk or sealing clay fluid is jetted into the excavated section through the injection pipe 14 provided in the guide post 8 of the cutter A or the cutter B as shown by an arrow O in FIGS. 10 and 12. As a result, a frontal working face $1A_1$ or $1B_1$ of a ground filling is formed and compressed to form an improved and compacted ground wall 1A or 1B and a surplus portion of the ground filling is forced into the section 15*c* to form a head of the compacted ground wall 1A or 1B.

In the illustrated embodiment 2C of the apparatus 2 as shown in FIGS. 13 and 14 that is partly similar in construction to the apparatus 2B and comprises the chassis 3, the framework 5, the frame 6, an endless chain cutter C that is partly similar in construction to the cutter B as shown in FIGS. 5 to 8*d* and comprises the endless chain 7 movable together with the chain sprocket 10, a number of the cutter and compressor sliders 19 supported pivotally on the chain 7 about the generally horizontal axes of the pins 16 and provided with the return springs 20, and a number of elongate partition members 22 arranged along the length of the guide post 8 across the excavated section 15, provided on their edges with a known resilient packing (not shown) engaging on side walls of the section 15 for sealing the small gapes between the edges and the side walls and adapted to guide the excavated ground being removed upwardly at ahead of the members 22 and a filling of a ready filler material such as sand or a cement concrete being poured downwardly into the section 15 behind the members 22 and supported by the member 22. A forward oriented, in relation to a direction shown by an arrow I in FIG. 13, sharpened edge of the slider 19 is capable of scraping the ready filling from at behind the member 22, the backward oriented, compressing slider facet portion 19*b* is capable of displacing the ready filling in the direction I toward the bottom 15*b* of the section 15 and in a direction shown by an arrow K in FIG. 13 on a frontal working face $1C_1$ of a compacted ready filling, underground continuous wall 1C to compact the face $1C_1$ and form the wall 1C from its lower portion, the lower portion being at behind and below a lower end of the member 22.

In operation, when each of the sliders 19 moves at ahead of the member 22 in the direction J in FIG. 13 and engages on the frontal facet portion of the member 22, the filling of the excavated ground is scraped from the frontal facet portion of the member 22 and removed in the direction J in FIG. 13. Each of the sliders 19 when moves in the direction I in FIG. 13 and engages on the rear facet portion of the member 22, supports the face $1C_1$, scrapes and displaces the ready filling in the direction I toward the bottom 15*b* and forces the ready filling against the bottom 15*b* and in the direction K in FIG. 13. When the slider 19 moves in the cutting and removing position at ahead of the member 22, the excavated ground is scraped from the frontal facet of the member 22 and removed in a direction shown by an arrow J in FIG. 13.

In constructing an underground continuous compacted ready filling wall 1C by the use of the apparatus 2C constructed described above, the endless chain cutter C having a desired length is assembled and placed on the ground surface as shown in FIG. 9*a*. Thereafter, the endless chain 7 of the cutter C is driven in directions shown by arrows I and J shown in FIG. 13, while the chassis 3 is advanced in the direction shown by an arrow H in FIG. 13, the cutter C inserts into the ground 4 in a direction shown by an arrow N in FIG. 9*a* and tilts about the frame 6 up to a predetermined depth to form a continuous groove in the ground 4.

Figure 15:
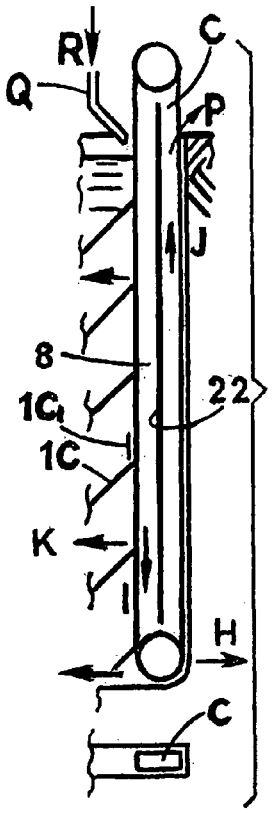
FIG. 15 is a view illustrating the processes of the third construction method according to the invention with using the apparatus shown in FIGS. 13 and 14.

FIGS. 9*a* and 15 illustrate the third construction method according to the invention by the use of the apparatus 2C. The endless chain cutter C of the apparatus 2C according to the invention that is provided with the partition member 22 and the sealing resilient packings and positioned on the ground 4. Thereafter the chassis 3 is driven in the predetermined direction shown by an arrow H in FIG. 15 to excavate the ground 4 and remove the excavated ground as shown by an arrow P in FIG. 15, while an injection pipe Q is inserted at behind the member 22 and the sealing packings and a ready filler such as sand or a hardening cement concrete is poured through the injection pipe Q into the excavated section as shown by an arrow R in FIG. 15. As a result, the excavated section is filled with the ready filler to form a ready filling, a frontal working face $1C_1$ of the ready filling is compressed from its lower portion to form a compacted ready filling wall 1C from its lower portion. The drive motor 9 and the sliders 19 can be used to assist the chassis 3 in moving up the guide post 8 in the excavated section before the face $1C_1$ of the wall 1C has hardened.

The illustrated embodiment 2D of the apparatus 2 as shown in FIGS. 16, 17, 17*a* and 17*b* that is partly similar in construction to the apparatus 2C and comprises the chassis 3, the framework 5, the frame 6 and an endless chain cutter D that is partly similar in construction to the cutter C as shown in FIGS. 13 and 14 and comprises the endless chain 7, the guide post 8, a number of known cutter members (not shown) for excavating the ground 4 and form the excavated section 15 and a number of compressor sliders 21 fixed to the chain 7, an elongated, excavated ground-guiding partition member 22 extending along the length and perpendicularly to a central longitudinal surface of and fixed rigidly to the guide post 8, a known sealing means such as resilient packings (not shown) provided on edges of the member 22 and engaging on the adjacent region of the side walls for sealing small gaps between side edges of the member 22 and adjacent region of trench side walls. Each of the sliders 21 (shown better in FIGS. 17*a* and 17*b*) has an outwardly and aside oriented edge for engaging on the facial wall 15*a* and side walls of the section 15, an oriented inwardly edge for engaging on a frontal facet portion of the member 22, and an excavated ground- and face-compressing, slider-shaped facet portion, is fixed to a link 7*a* of the chain 7 and positioned at the back angle relative to the chain 7 and a direction of longitudinal displacement as shown by an arrow J in FIG. 16. A plurality of the agitator bars 18 as shown in FIG. 14*a* are extended into crossing with the sliders 21, and each of the sliders 21 is shaped into an agitator comb having cuts for passing the bars 18 for agitating a filling of the excavated ground and the improving material to mix them together ahead of the member 22.

Figures 20, 21, 22:
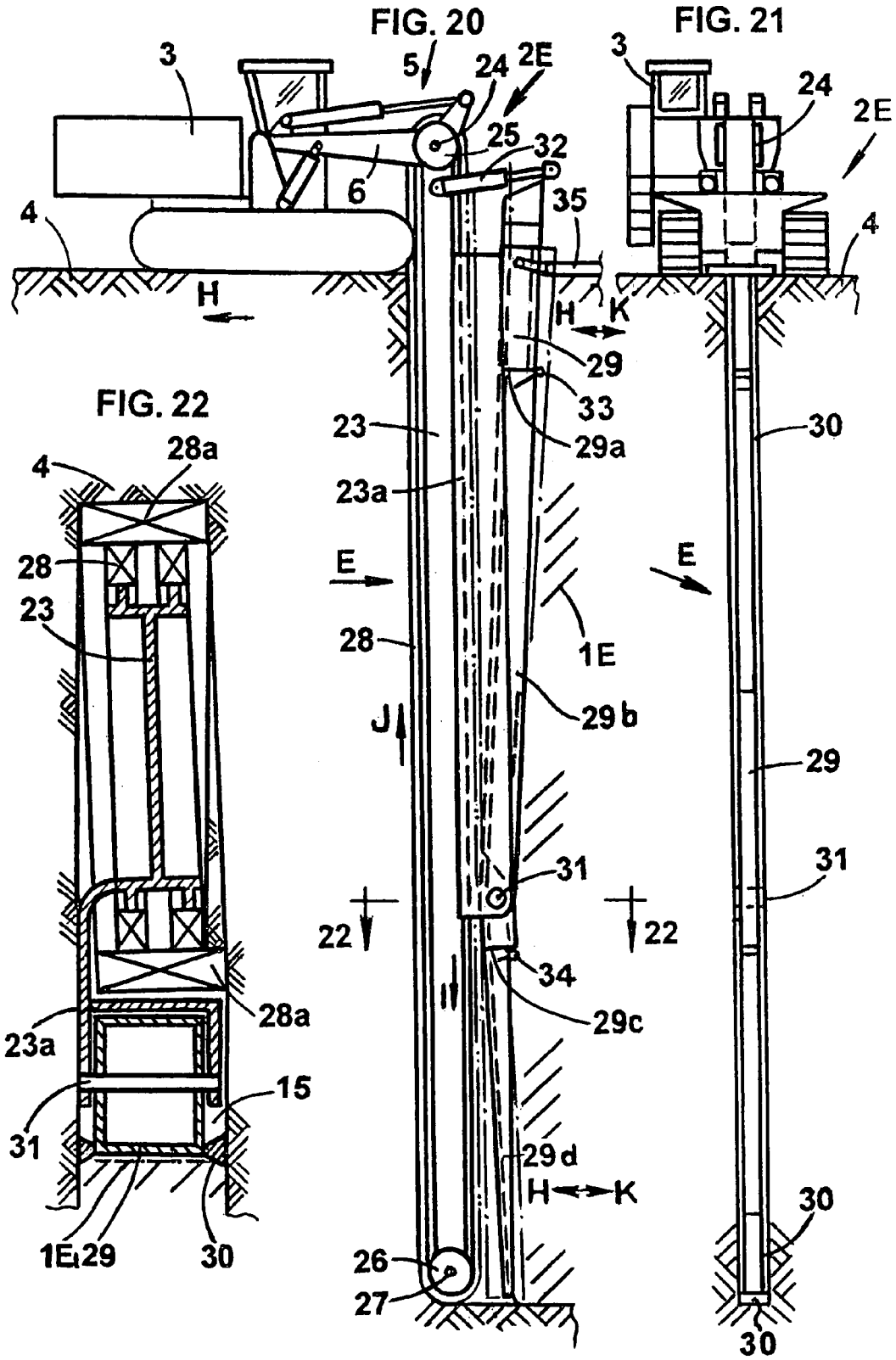
FIG. 20 is a side view of a fifth preferred embodiment of the apparatus according to the invention.
FIG. 21 is a view from the rear of the apparatus shown in FIG. 20.
FIG. 22 is a cross-sectional view taken on line 22-22 on a slightly enlarged scale relative to the FIGS. 21 and 22 of a compressor pipe shield used in the endless chain cutter of the apparatus shown in FIG. 20 according to the invention.

In operation, the member 22 when is inserted into the excavated section 15 that is capable of guiding the excavated ground being forced by the compressor sliders 21 downwardly in a direction shown by an arrow I in FIGS. 16, 22 to a lower portion of the face $1D_1$ and each of the sliders 21 is capable of forcing the excavated ground at ahead of the member 22 downwardly in the direction I, agitating the excavated ground filling to be mixed with the improving material, and forcing a mixture of the excavated ground and the improving material in a direction shown by an arrow M in FIG. 16 into between a lower end of the member 22 and the bottom 15*b* and on a lower portion of the face $1D_1$ so that the section 15 at behind the member 22 that will be filled with the mixture from its lower portion and the mixed filling will be compacted. Thereafter, when the slider 21 being displaced at behind the member 22 in the direction J it is capable of being forced into engagement on a rear facet portion of the member 22, the side walls and the face $1D_1$ and into interaction with the filling at behind the member 22 and will scrape the filling from the rear facet portion in the direction K and compress on the face $1D_1$ to advance and compact the improved ground wall 1D. Then the slider 21 is capable of being displaced through above the ground 4 to repeat the operations of compressing the filling on the face $1D_1$ in this way as part of a sequence involving the moving of the cutter D.

In constructing an underground continuous compacted ground wall 1D by the use of the apparatus 2D constructed described above, the endless chain cutter D having the desired length is assembled and placed on the ground surface as shown in FIG. 9*a* or inserted into a ditch section 15*c* of an excavated section 15 dug previously in the ground 4 by means of an excavating device (not shown) such as a plough ditcher at a position where the wall 1D is to be formed. Thereafter, the endless chain 7 of the cutter D is driven by means of the motor 9 in the directions I, M and J shown in FIG. 13, while the chassis 3 is driven to advance in the direction H to form a continuous groove in the ground 4. The motor 9 and the sliders 21 can be used to assist the chassis 3 in moving up the guide post 8.

Figure 18:
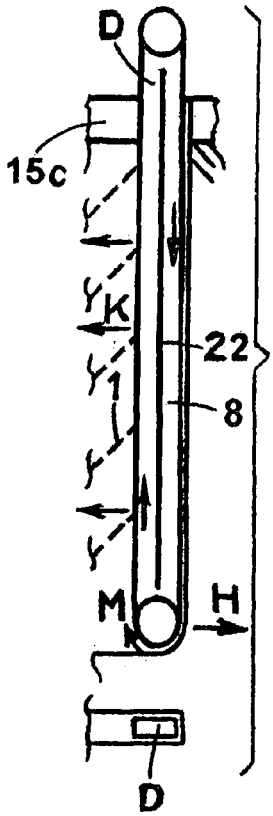
FIG. 18 is a view illustrating the processes of the first construction method according to the invention with using the apparatus shown in FIGS. 13 and 14.

FIGS. 9*a* and 18 illustrate the first construction method according to the invention with using the apparatus 2D. The endless chain cutter D of the apparatus 2D according to the invention is inserted into a ditch section 15*c* dug previously in the ground 4 to a predetermined depth, width and length by means of an excavating device (not shown) such as a plough ditcher. Thereafter the chassis 3 is driven in the predetermined direction shown by an arrow H in FIG. 9*a* to excavate the ground 4 in a direction shown by an arrow N. As a result, a frontal working face $1D_1$ of the filling is formed and compressed from its lower portion to form a compacted mixed ground wall 1D and a surplus portion of the mixed ground filling is displaced into the ditch portion 15*c* to form a head of the wall 1D.

Figure 19:
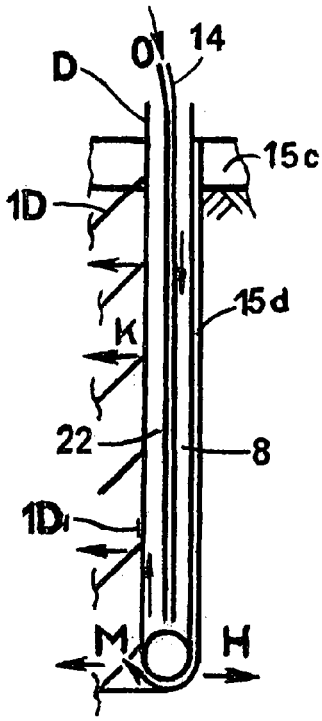
FIG. 19 is a side view illustrating the processes of the second construction method according to the invention with using the apparatus shown in FIGS. 16 to 17*b;*

FIGS. 9*a* and 19 illustrate the second construction method according to the invention with using the apparatus 2D. First, an upper ditch section 15*c* of an excavated trench 15 is dug in the ground 4 to a predetermined depth, width and length by means of a excavating device (not shown) such as a plough ditcher as shown in FIG. 18. The endless chain cutter D of the apparatus 2D according to the invention is then inserted into the ditch section 15*c*. Thereafter the chassis 3 is driven in the predetermined direction shown by an arrow H in FIG. 9*a* to excavate the ground 4, while a running, ground filling-improving material such as clayey fluid is jetted into the excavated section through the injection pipe 14 provided in the partition member 22 of the cutter D as shown by an arrow O in FIG. 19. As a result, a frontal working face $1D_1$ of the improved ground filling is compressed from its lower portion to form an improved and compressed ground wall 1D and a surplus portion of the improved ground filling is displaced into the ditch section 15*c* to form a head of the wall 1D. The drive motor 9, the endless chain 7 and the sliders 21 before the improved ground wall 1D has hardened that can be used to assist the chassis 3 in moving up the guide post 8.

In the illustrated embodiment 2E of the apparatus 2 shown in FIGS. 20 to 22, the apparatus 2E is partly similar in construction to the endless chain apparatuses 2A and 2B and provided with the shown in FIG. 1 movable chassis 3, the framework 5 including the upper tiltable frame 6 and the lower tiltable frame shaped into a vertically preferably disposed, elongate guide post 23 supported pivotally at its upper portion by the frame 6, a drive means such as a hydraulic power motor 24 having an output shaft (not shown) to which a chain driving wheel 25 is connected, a chain sprocket 26 rotatably supported on a lower end of the guide post 23 by means of a pivotal pin 27, an endless chain 28 extended around the driving wheel 25 and the chain sprocket 26, a number of cutter bits 28*a* fixed to the chain 28 to form an endless chain cutter E. To compress a working end face $1E_1$ of an underground continuous filling wall 1E being formed with a running filler material such as cement concrete and the like in the section 15 being excavated, the apparatus 2E is provided with a vertically preferably disposed, filling 1E-forming and filling wall face $1E_1$-compressing, shield-shaped injection pipe 29 extending from the framework 5 down at behind and along the length of an underground portion 23*a* of the guide post 23 and across the section 15. The small gaps between side edges of the injection pipe shield 29 and side walls of the section 15 that are sealed with known resilient packings 30 fixed on sides of the pipe shield 29 and engaging on the side walls to prevent the loss of the filler mortar with the endless chain cutter E from the face $1E_1$. The pipe shield 29 is supported at its underground portion on an underground portion of the guide post 23 by a pivotal connecting means for forward and backward oscillation about a generally horizontal shield pivotal axis, where the shield pivotal axis being within underground portions of the guide post 23 and pipe shield 29 and perpendicular to a central longitudinal plane of the pipe shield 29. The shield pivotal means includes a bearing means comprising a bearing element such as a vertically-disposed, ski-shaped underground portion 23*a* of the guide post 23 that extended downward in a direction shown by an arrow I in FIG. 22 and backward in a direction shown by an arrow K in FIG. 22, a plurality of bearing members such as lugs distributed co-axially and transversally within the widened portion 23*a*, a plurality of bearing members such as lugs distributed co-axially and transversally within the transversally widened pipe shield 29, and an elongated bearing part such as a pivotal pin 31 being co-axial with the shield pivotal axis, and being configured to allow limited oscillation of the pipe shield 29 relative to the guide post 23 about the shield pivotal axis. The pipe shield 29 has preferably a ←shaped central longitudinal axis with a forward oriented vertex on the shield pivotal axis. The central longitudinal plane of the cutter E crosses the advancing direction H, the direction H being on the central longitudinal plane of the pipe shield 29, at a determined angle, the angle being equal to about 98-99°, preferably 99° so that the post portion 23*a* extends aside and past closely, with a clearance, cutter bits 28*a*, where each of the known cutter bits 28*a* is capable of being forced into interaction with the wall 15*a* to urge the cutter E in a lateral direction crossing the planes toward the direction H.

The drive means for effecting the alternating forward and backward oscillation of the pipe shield 29 about the pipe shield pivotal axis that consists in part of a motive power unit such as a double-acting hydraulic cylinder and piston unit 32 pivotally secured from the rear to the guide post 23 and connected via a linkage or bracket to the pipe shield 29. The pipe shield 29 has an orifice 29*a* located between the ground level and the pivotal axis of the pin 31 and provided with a check valve 33 capable of opening by means of pressure and weight of the liquid mortar which being located above and injected in the section 15 and closing by pressure of the liquid mortar being compressed on an upper portion of the face $1E_1$ by an upper, chute-shaped, open, compressing portion 29*b* which being below the valve 33 and above the axis of the pin 31, a middle portion 29*c* which being at below the axis of the pin 31 and provided with a check valve 34 capable of opening by means of pressure of the liquid mortar located above and being injected in the section 15 and closing by aid of pressure of the mortar being compressed on a lower compressing portion 29*d* of the pipe shield 29 being below the axis of the pin 31 to prevent return flow of the liquid mortar into the pipe shield 29 and in the direction J, when the mortar is compressed by means the compressing shield portion 29*d* on a lower portion of the face $1E_1$, and an extending horizontally, upper wall face-supporting ski means 35 that is connected to an upper portion of the pipe shield 29 and engaged on an upper region of the side walls of the section 15 and seals the upper region the section 15.

In operation, as the face-compressing, injection pipe shield 29 with the packings 30 is advanced with the guide post 23 in the excavated section 15 and the guide post 23 is drawn up with the framework 5, the filler mortar can be poured through the pipe shield 29 and open the check valves 33 and 34 so that the section 15 will be filled with the mortar and the wall 1E will be formed. The packings 30 slide on the bottom 15*b* and the side walls of the section 15 so as to locate between the cutter E and the face $1E_1$, and the ski means 35 supports the upper working face $1E_2$ of the wall 1E so that an upper section of the wall 1E which being formed and compressed that will be closed off in relation to its exterior and prevented against the removal and soiling with the excavated ground. As the oriented in a direction shown by an arrow K in FIG. 20 compressing back portions 29*b* and 29*d* of the pipe shield 29 swing about the pivotal axis of the pin 16 backward in the direction K and forward in a direction shown by an arrow H in FIG. 20, the wall 1E will be formed as the mortar is poured through the pipe shield 29 and opens the check valves 33 and 34 and fills the section 15 being formed, and the face $1E_1$ will be compressed as the mortar on the compressing shield portions 29*b* and 29*d* is agitated and forced in the direction K and compressed on the face $1E_1$ thereof. When the upper compressing shield portion 29*b* moves in the direction K and the lower compressing shield portion 29*d* moves in the direction H about the axis of the pin 31, the portion 29*b* compresses the mortar which being within the portion 29*b* in the direction K on the upper portion of the face $1E_1$ and on the check valve 33 to close, and forces the mortar down through a middle portion of the pipe shield 29 past the pin 31 to open the check valve 34 into the lower portion of the section 15, while the portion 29*d* retreats from a lower portion of the face $1E_1$ being below the axis of the pin 31 and forms a lower gap between the lower portion of the face $1E_1$ and the portion 29*d* so that the mortar is sucked from the open valve 34 into the lower gap and fills the lower gap and forms a lower portion of the wall 1E. When the upper portion 29*b* moves in the direction H and the portion 29*d* moves in the direction K about the axis of the pin 31, the portion 29*d* forces the mortar in the direction K and compresses on the lower portion of the face $1E_1$, and the mortar forces and closes the check valve 34, while the upper portion 29*b* retreats from the upper portion of the face $1E_1$ and forms an upper gap between the upper portion of the face $1E_1$ and the portion 29*b* so that the mortar is sucked from the upper portion 29*a* and forces and opens the check valve 33 and is poured through the check valve 33 into the upper gap and fills the upper gap and an upper portion of the wall 1E will be formed.

In constructing an underground continuous compacted filling wall 1E by the use of the apparatus 2E constructed described above, the endless chain cutter E having the desired length is assembled and placed on the ground surface as shown in FIG. 9*a* at a position where the wall 1E is to be formed. Thereafter, the endless chain 28 of the cutter E is driven by means of the motor 24 in directions shown by arrows I and J in FIG. 20, while the chassis 3 is advanced in the direction H to form a continuous groove of the intended depth in the ground 4.

Figure 23A:
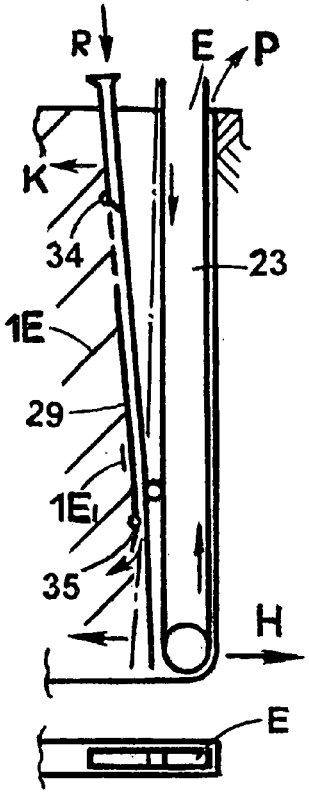
FIGS. 23*a* and 23*b* are views illustrating the processes of the third construction method according to the invention with utilizing the apparatus shown in FIGS. 20-22.
Figure 23B:
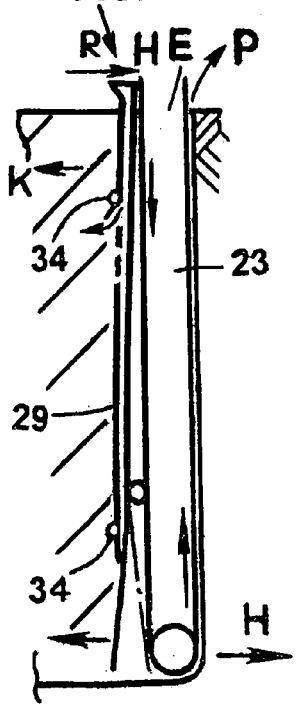

FIGS. 9*a*, 23*a* and 23*b* illustrate the third construction method according to the invention by the use of the apparatus 2E. The endless chain cutter E of the apparatus 2E according to the invention is assembled and placed into a horizontal starting position represented in FIG. 9*a* on the ground 4 where the underground continuous wall 1E is to be formed. Thereafter, the chassis 3 is driven in the predetermined direction shown by an arrow H in FIG. 9*a* to excavate the ground 4 and remove the excavated ground as shown by an arrow P in FIG. 23*a*, while an injection and compressor, pipe shield 29 provided in the cutter E that is inserted into the excavated section and a running filler material such as hardening cement concrete or mortar is poured in the section through the injection pipe shield 29 as shown by an arrow R in FIGS. 23*a* and 23*b*. As a result, the excavated section is filled with the ready filler material to form a ready filling, a working frontal face $1E_1$ of the ready filling is compressed to form a compacted ready filling wall 1E.

FIGS. 9*a*, 23*a* and 23*b* illustrate also other construction method according to the invention by the use of the apparatus 2E. First, an agitator and compressor (not shown) is prepared, which is substantially similar in construction to the endless chain cutter E and provided with an agitator and compressor shield 29. The cutter E of the apparatus 2E according to the invention is placed on the ground 4. Thereafter, the chassis 3 is driven in the predetermined direction shown by an arrow H in FIG. 9*a* to excavate the ground 4 in a direction shown by an arrow N in FIG. 9*a* and the arrow H and to remove the excavated ground as shown by an arrow P in FIG. 23*a*, while the agitator pipe shield 29 which is substantially similar in construction to the compressor pipe shield 29 that is inserted behind the cutter E and a ready filler such as cement concrete or mortar is poured through the injection pipe provided in the agitator pipe shield 29 as shown by an arrow R in FIG. 23 and the agitator 29 is driven in the directions shown by the arrows H and K. As a result, the excavated section is filled with the ready filler to form a ready filling, a frontal working face $1E_1$ of the ready filling is compressed to form a compacted ready filling wall 1E as shown in FIGS. 23*a* and 23*b*.

The hydraulic unit 32, the pipe shield 29 and the sealing packings 30 can be used to assist the chassis 3 in moving up the guide post 8 in the excavated section before the face $1E_1$ has hardened. The bearing element of the underground portion 23*a* of the guide post 23 can be used to support other face-compressing means according to the invention, such as rotating screw spiral compressors (later described).

An embodiment 2F of the apparatus 2 as shown in FIGS. 24 to 27*a* that is partly similar in construction to the apparatuses 2D and 2E and comprises the chassis 3, the framework 5 including the upper tiltable frame 6 and the lower tiltable frame shaped into a vertically preferably disposed, elongate guide post 36 of an endless chain cutter F, a hydraulic preferably power motor 37 supported on a saddle (not shown) and having a shaft (not shown), a chain sprocket 38 rotatably supported on a lower end of the guide post 36 by means of a pin 39, a chain driving wheel 40 connected to the shaft of the motor 37, an endless chain 41 extending around the chain sprocket 38 and the driving wheel 40, a number of cutter bits 42 fixed to the endless chain 41 to form the endless chain cutter F, an elongate, shaped into a two-support beam, shield 43 for supporting a frontal working face $1F_1$ of an underground, continuous compacted ready filling wall 1F and a means for compacting the wall 1F such as the above-mentioned, agitator, compressor and shaped into an injection pipe, shield 29 or rotating screw spiral compressor (later described). The shield 43 is supported at its upper end preferably on an upper portion of the guide post 36 located above the ground 4, extended down at behind closely the cutter F into and across the excavated section 15 and supported at its lower portion on an underground portion of the guide post 36. A head of the section 15 and a small gap between the shield 43 and a bottom and side walls of the section 15 are sealed with a sealing means 44 comprising known resilient packings 44*a* provided on shield edges and engaging on the bottom 15*b* and the side walls and a ski-shaped slip cover 44*b* connected from behind to the shield 43 for engaging on the upper region of the side walls. The underground supporting means comprises a number, two preferably, of co-axially disposed and oriented in direction shaped by an arrow K in FIG. 26 and opposite an intended advancing direction shown by an arrow H in FIG. 24, cam wheels 45 rotatably connected by means of a shaft 46 to the underground portion of the guide post 36 and extended on each side of the chain 41 for rotation with the shaft 46 about a generally horizontal cams pivotal axis, where the cams pivotal axis being perpendicular to a central longitudinal plane of the underground portion of the guide post 36. The shaft 46 being cinematically connected to the chain 41 by means of a known mechanical transmission such as an endless chain transmission 47 comprising a second chain driving wheel (not shown) secured co-axially on the sprocket 38, a chain driven wheel (not shown) secured co-axially on the shaft 46, and a second endless chain extending around the second chain driving wheel and the driven chain wheel and being capable of rotating the wheels 45 concordantly with longitudinal displacement of the chain 41. Each of the wheels 45 comprises a number, three preferably, of radial cam portions 45*a* adapted to extend equidistantly from a hub of the wheel 45 and aside the chain 41 and alternately between adjacent cutter bits 42 toward the shield 43 and having the predetermined length and a sliding end lobe. A number, two preferably of forward oriented, in relation to the direction H, cams-supporting, rolls or wheels 48 rotatably connected oppositely the wheels 45 and from the front to the underground portion of the shield 43 by means of pins 49 for step-bearing alternately and uninterruptedly the lobes of the cam portions 45*a*. The wheels 45 and the wheels 48 are capable of being forced into alternate and uninterrupted interaction and the cam portions 45*a* are operable to support continuously and mutually the underground portions of the guide post 36 and the shield 43 by the drive motor 37 capable of rotating the wheels 45 with the endless chain transmission 47 and the wheels 48 with the cam portions 45*a* of the wheels 45.

Figure 26:
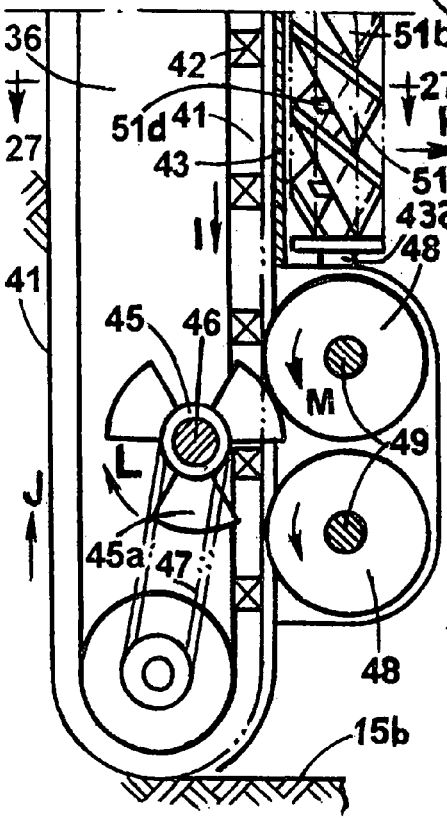

In operation, as the motor 37 rotates the wheels 45 in a direction shown by an arrow L in FIG. 26, the direction L corresponding to the direction I of movement of a backward oriented portion of the chain 41, with the wheel 40 and the chain 41 and the sprocket 38 and the transmission 47, so an advanced cam portion 45*a* performs and ends its way ahead of a cutter bit 42 being moved in the direction I and secures a firm rolling contact with the lower, for example, wheel 48 for supporting mutually the underground portions of the guide post 36 and shield 43, and immediately a next in turn, followed cam portion 45*a* starts its way behind that cutter bit 42 and its firm rolling contact with the upper wheel 48 so that the underground portions of the guide post 36 and shield 43 being further supported mutually and thus all these cam portions 45*a* and wheels 48 will support mutually, alternately and continuously the underground portions of the guide post 36 and shield 43. There it is possible to use the shield 43 to support other compressing means according to the invention, such as spiral screw compressors (later described).

A screw spiral means shown in FIGS. 24-27*a* in a modification of a compressor for the embodiment F it can be used also for forming a trench-shaped excavation in the ground 4, filling an excavated section 15 being formed with the excavated ground or a running, ready filler material such as a hardening cement concrete or clay mortar and the like. A vertically-disposed, elongate, filling-forming, screw spiral compressor 51 is extending at behind and along the length of the supporting shield 43 down from an injection pipe 50 having a lower end opening at an upper underground portion of the shield 43 that is shaped co-axially, relative to a generally vertical central longitudinal axis of the screw compressor 51, the screw compressor axis being within a central longitudinal plane of the endless chain cutter F, with the ability to rotate about the screw axis by a power drive means such as a hydraulic preferably motor 52 having a driving output shaft (not shown). The screw compressor 51 has a co-axially disposed, upper supporting ring member 51*a* connected to the shaft of the motor 52, a number, preferably two spiral screw-shaped, filling-compressor sliders 51*b* and 51*c* fixed at their upper ends on the ring member 51*a*, connected together with a number of distributed downwardly and radially positioned, elongate, agitator planks 51*d* and being supported on the shield 43 for rotation by a bearing means comprising a number of bearing ring members 51*e* fixed co-axially to the sliders 51*b* and 51*c* and the number of co-axial outer bearing bracket ring members of journal holder portions 43*a* distributed downwardly within the length of the shield 43. Coils of the screw sliders 51*b* and 51*c* are positioned at the downward oriented back angle (see above) relative to the screw axis of rotation and generate an axial, injection pipe-shaped channel extending from the framework 5 into inside the sliders 51*b* and 51*c* and through the members 51*a*, 51*e* and 43*a* and the planks 51*d* and having two screw-shaped lateral gaps opening between the sliders 51*b* and 51*c*.

In operation, as the shield 43 with the sealing packings 44 are inserted into the excavated section 15 and drawn with the guide post 36 in the direction H with the framework 5 and the running filler material moves down through the injection pipe 50*a*, the sliders 51*b* and 51*c*, the planks 51*d* and the members 51*a* and 51*e* to a lower end of the compressor 51, a column of the ready filling will be formed inside the sliders 51*b* and 51*c*. As the planks 51*d* are rotated with inner edges of the sliders 51*b* and 51*c* in a direction shown by an arrow L in FIG. 27, the direction L is opposite to the direction of the spiral screws, a column of the ready filling which being within the screw compressor 51 will be agitated and forced axially down in the direction I to the bottom 15*b* and radially outwardly, in relation to the screw axis, and compressed on the face $1F_1$.

Figure 27:
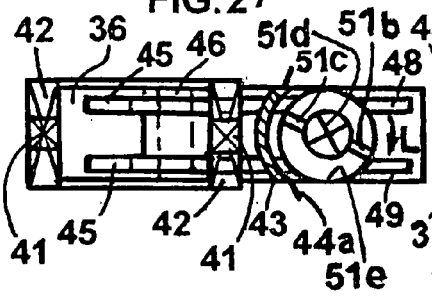
Figure 27A:
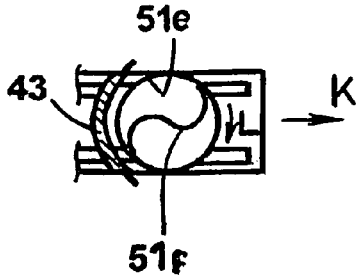

In other example according to the invention as shown in FIG. 27*a* a rotating screw compressor means is similar partly in construction to the compressor 51 and comprises a filling-compressing screw slider 51*f* having a filling-compressing facial portion of an equiangular spiral-shaped cross-section, where the angle of the equiangular spiral is equal to the above mentioned back angle and oriented in a direction of rotation as shown by an arrow L in FIG. 27*a*. The slider 51*f* generates an injection channel extending from the lower end of the injection pipe 50 down and opening laterally within the depth of the face $1F_1$. The screw slider 51*e* is able to be mounted to the ring members 43*a*, 51*a* and 51*e* instead of the sliders 51*b* and 51*c*.

In operation, as the ready filler material moves through the injection pipe 50 and the members 43*a*, 51*a* and 43*e* along the equiangular compressor slider 51*f* toward the lower end of the agitator and compressor 51 and the equiangular slider 51*f* rotates about the generally vertical axis of rotation in the direction L in FIG. 27*a*, the ready filler on the compressor slider 51*f* will be forced radially about the vertical axis of rotation to the face $1F_1$ and compressed on the face $1F_1$.

In constructing an underground continuous compacted ready filling wall 1F by the use of the apparatus 2F constructed described above, the endless chain cutter F having the desired length is assembled and placed in a horizontal starting position on the ground surface as shown in FIG. 9*a* where the wall 1F is to be formed. Thereafter, the endless chain 41 of the cutter F is driven by means of the hydraulic motor 37 in directions shown by the arrows I and J in FIG. 26 and the sliders 51*b* and 51*c* or the slider 51*f* of the compressor 51 are driven by the motor 52 to rotate about the vertical axis in an intended direction shown by an arrow L in FIG. 27 and opposite to the direction of the spiral screw, while the chassis 3 is advanced in the direction shown by an arrow H in FIG. 24 to form a continuous groove in the ground 4.

Figure 28:
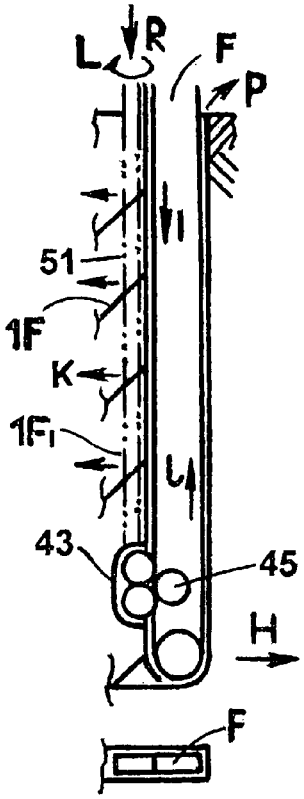
FIG. 28 is a view illustrating the processes of the third construction method according to the invention with utilizing the apparatus shown in FIGS. 24-27*a;*

FIGS. 9*a* and 28 illustrate the first construction method according to the invention and using the apparatus 2F. The endless chain cutter F of the apparatus 2F according to the invention is inserted into a horizontal working position on the ground 4. Thereafter, the chassis 3 is driven in the predetermined direction shown by an arrow H in FIG. 9*a* to excavate the ground 4 and remove the excavated ground as shown by an arrow P in FIG. 28 so that the cutter F is inserted into the ground 4 in a direction shown by an arrow N in FIG. 9*a*, while a running ready filler material is injected into the excavated section through the injection pipe 50 and the compressor 51 in the section as shown by an arrow R in FIG. 28. As a result, the section is filled forcedly with the material and a frontal working face $1F_1$ of a ready filling is compressed to form a compacted ready filling wall 1F.

FIGS. 9*a* and 28 illustrate also the second construction method according to the invention and using the apparatus 2F. First, a compressor (not shown) is prepared, which is substantially similar in construction to the endless chain cutter F and includes a shield 43 and a screw compressor 51. The cutter F of the apparatus 2F according to the invention is positioned on the ground 4. Thereafter, the chassis 3 is driven in the predetermined direction shown by an arrow H in FIG. 9*a* so that the cutter F is inserted into the ground 4 in the direction N as shown in FIG. 9*a* and into a vertical preferably operative position to excavate the ground 4 and remove the excavated ground as shown by an arrow P in FIG. 28, while the screw compressor 51 is inserted behind the cutter F and a ready filler material is poured through the screw compressor 51 as shown in FIG. 28 to form a ready filling and a frontal working face $1F_1$ of the ready filling is compressed to form a compacted ready filling wall 1F.

The motor 52 and the compressor 51 can be used before the face $1F_1$ has been hardened to assist the chassis 3 in moving up the guide post 36.

Figures 29, 30, 31, 32, 33, 34:
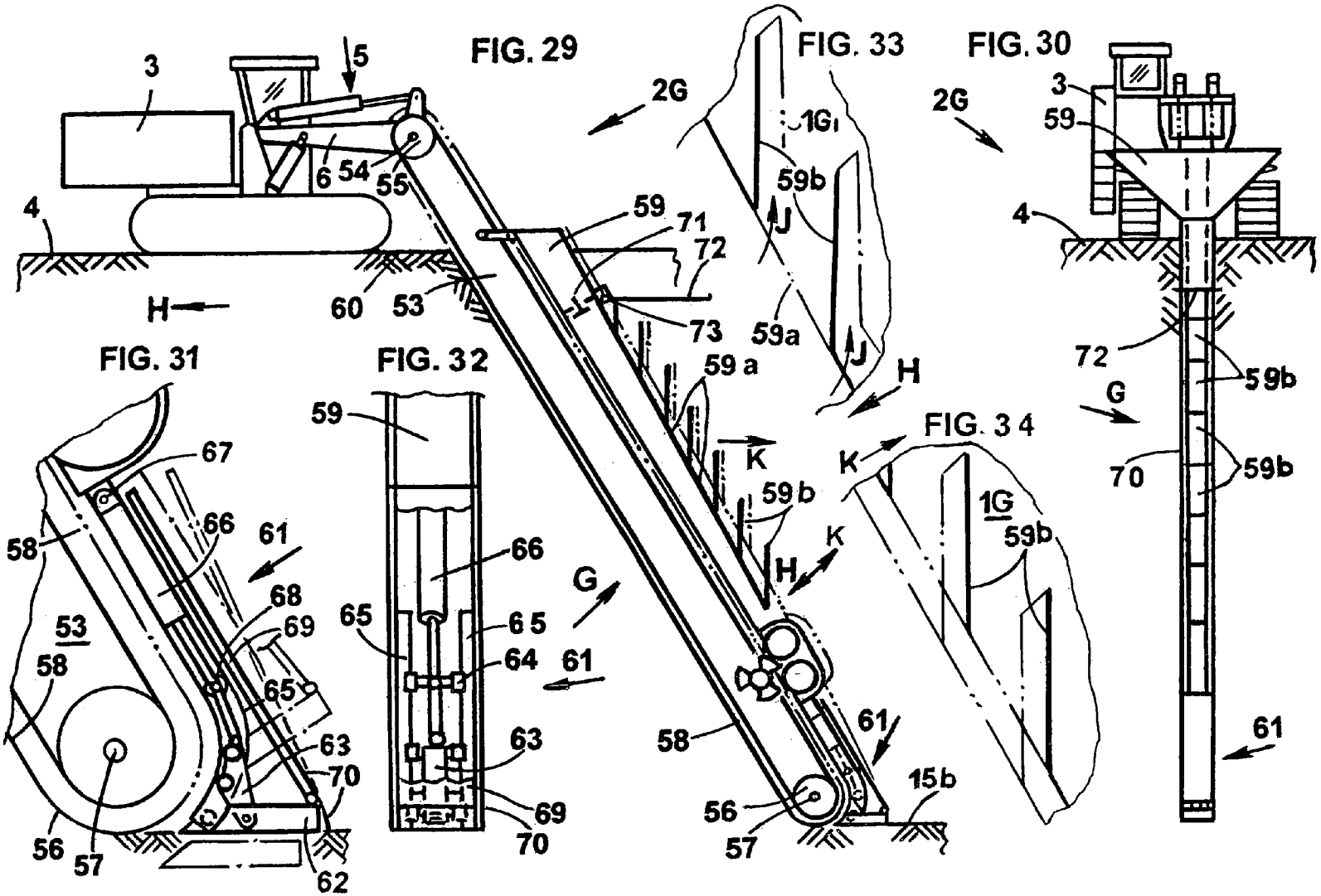
FIGS. 29 and 30 are side and from the rear views of a seventh preferred embodiment of the apparatus according to the invention, respectively.
FIGS. 31 and 32 are partly side and from the rear on a slightly enlarged scale views of an oscillating tail ski and a compressor shield used on the endless chain cutter of the apparatus shown in FIGS. 29 and 30, respectively.
FIGS. 33 and 34 are partly side views in retreated and compressing operative positions on a slightly enlarged scale of the compressor injection pipe shield of the apparatus shown in FIGS. 29 to 32 according to the invention, respectively.

An illustrated embodiment 2G of the apparatus 2 as shown in FIGS. 29 to 34 that is partly similar in construction to the apparatuses 2E and 2F and comprises the chassis 3, the framework 5 including the upper frame 6 and the lower frame shaped into an elongate guide post 53 supported at its upper portion on the frame 6 and disposed inclinedly backward, relative to an intended advancing direction shown by an arrow H in FIG. 29 at a predetermined angle, the angle being equal preferably to about 60° relative to the horizontal plane, a drive hydraulic preferably motor 54 provided on the guide post 53 and having the output shaft, a chain driving wheel 55 connected to a shaft of the motor 54, a chain sprocket 56 rotatably supported on a lower end of the guide post 53 by means of a pin 57, an endless chain 58 extending around the driving wheel 55 and the chain sprocket 56, a number of cutter bits (not shown) fixed to the chain 58; an elongate, filling-compressing, shield-shaped injection pipe and compressor 59 located at behind the cutter G and supported pivotally at its upper end on the guide post 53 about a generally horizontal shield pivotal axis of a pivot hinge means 60 which shield pivotal axis being perpendicular to a central longitudinal plane of the pipe shield 59, and at its lower end on the bottom 15*b* of the section 15 by a filling-compressing and bottom-ramming means 61 comprising a self-aligning, rammer and compressor tail ski 62 shown better in FIGS. 31 and 32, pivoted at its middle portion about a lower end of a carriage 63 movable with rolls 64 along the pipe shield 59 on guide rails 65 and adapted to be driven by a double acting, power hydraulic cylinder and piston unit 66 suitably coupled as at 67 via a bracket or the like to the lower portion of the pipe shield 59 and as at 68 by a linkage or a bracket or the like to the carriage 63 so as to move the tail ski 62 with the carriage 63 between a pipe shield 59—extending downward lower operative position represented by chain-dotted lines in FIG. 31 through a middle operative position represented by full lines in FIGS. 31 and 32 and a pipe shield 59—shortening upwardly, upper transporting position represented also by chain-dotted lines in FIG. 31. The tail ski 62 in the upper position can thus be nearly to the support means 60 that a lower end of the cutter G and permit the pipe shield 59 to be inserted from a starting, horizontal operative position represented in FIG. 9*a* into the section 15 follow the cutter G and to the middle operative position. The compressing and ramming means 61 comprises a face-compressing shield 69 and resilient scrapers 70 provided on edges of the shield 69 to engage on side walls and the bottom 15*b* of the section 15 for sealing the small gaps between the pipe shield 59 and the bottom 15*b* and side walls. The bottom-ramming ski 62 and the carriage 63 can thus be positioned more far from the supporting pivotal means 60 than the lower end of the cutter G and lengthen the pipe shield 59 toward the bottom 15*b* to secure supporting a frontal working face $1G_1$ of a ready filling wall G1 being formed in relation to the bottom 15*b* and ramming the bottom 15*b*. In the upper transporting position the pipe shield 59 is able to be supported at its lower portion on the guide post 53 by a middle supporting means like shown above by reference characters 45-49 in FIGS. 24, 26, 27. The unit 66 is capable of producing alternating oscillation of the pipe shield 59 in directions shown by arrows H and K in FIG. 29 about the axis of the hinge means 60. The injection shield pipe 59 extends from the hinge means 60 positioned above the ground level toward the compressing and ramming means 61, is provided with an entrance check valve 71 opening downwardly, a horizontally disposed, elongate, upper working wall face-supporting slider damper 72 connected at from behind the pipe shield 59 by means of a coupling 73 permitting relative limited movement between the pipe shield 59 and the slider 72 and having the ability to extend across an upper region of the section 15, and has a number of orifices 59*a* disposed below the check valve 71 up to the supporting means 61 and a number of extending vertically, oriented in the direction K, face-compressing facet portions 59*b* positioned between the orifices 59*a*. As the portions 59*b* swing in forward and backward directions shown by arrows H and K in FIGS. 29, 33 and 34 about the axis of the pivotal means 60, a compacted ready filling wall 1G will form as a running ready filler material such as a cement mortar is injected through the check valve 71 and the orifices 59*a* in a direction as shown by an arrow J in FIG. 33 into gaps formed between the portions 59*b* and the face $1G_1$ and is forced by the portions 59*b* in the direction K as shown in FIG. 34 and compressed on the face $1G_1$.

In constructing an underground continuous compacted ready filling wall 1G by using the apparatus 2G constructed described above, the endless chain cutter G having a desired length that is assembled and placed in a horizontal position on the ground surface as shown in FIG. 9*a* where the wall 1G is to be formed. The unit 66 is then moves the ski 62 into the shortened position and thereafter the chain 58 of the cutter G is driven by means of the motor 54 in directions shown by arrows I and J in FIGS. 29 and 31, while the chassis 3 advances in the direction shown by an arrow H in FIG. 29 to form a continuous excavated trench section in the ground 4.

Figure 35A:
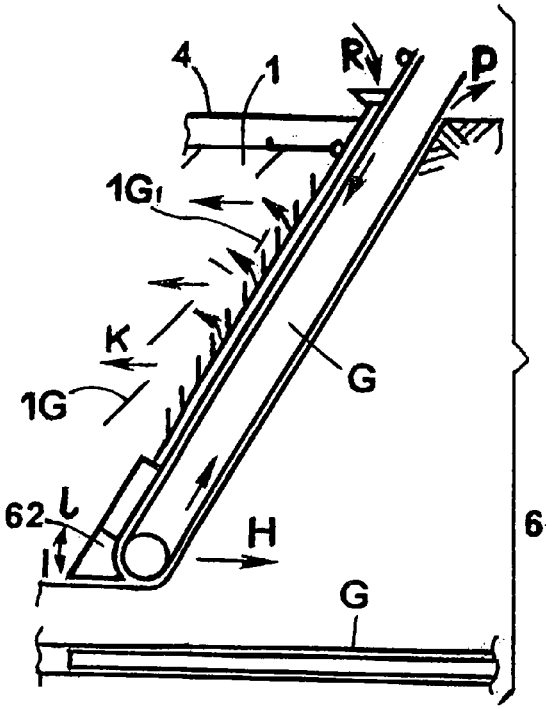
FIGS. 35*a* and 35*b* are views illustrating the processes of the third construction method according to the invention with using the apparatus shown in FIGS. 29 to 34.

FIGS. 9*a* and 35*a* illustrate the third construction method according to the invention with using the apparatus 2G. The endless chain cutter G of the apparatus 2G according to the invention that including the compressor and injection pipe shield 59, the oscillating ski means 62 and the compressor shield 69 is placed on the ground 4. Thereafter, the chassis 3 is driven in the predetermined direction shown by an arrow H in FIG. 9*a* to excavate the ground 4 and remove the excavated ground as shown by an arrow P in FIG. 35*a* and the cutter G inserts into the ground 4 in a direction shown by an arrow N as shown in FIG. 9*a*, where the oscillating ski means 62 is driven in the predetermined opposite directions I and J in FIG. 35*a*, while a running, hardening ready filler material such as a cement concrete mortar is poured in the excavated section through the pipe shield 59 as shown by an arrow O in FIG. 35*a*. As a result, the bottom of the excavated section is rammed, the ready filler material in the pipe shield 59 being oscillated is easily fill the section, the section is filled with the ready filler material to form a ready filling, a frontal working face 1$G_1$ of the ready filling is compressed to form a compacted ready filling wall 1G.

Figure 35B:
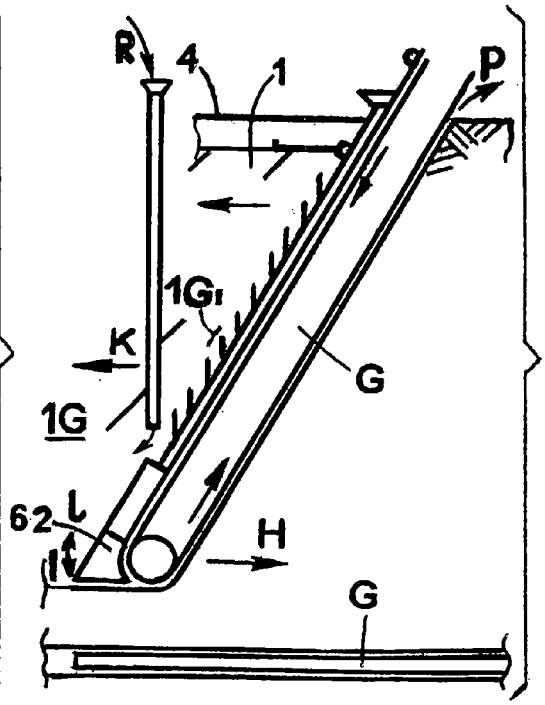
Figure 24:
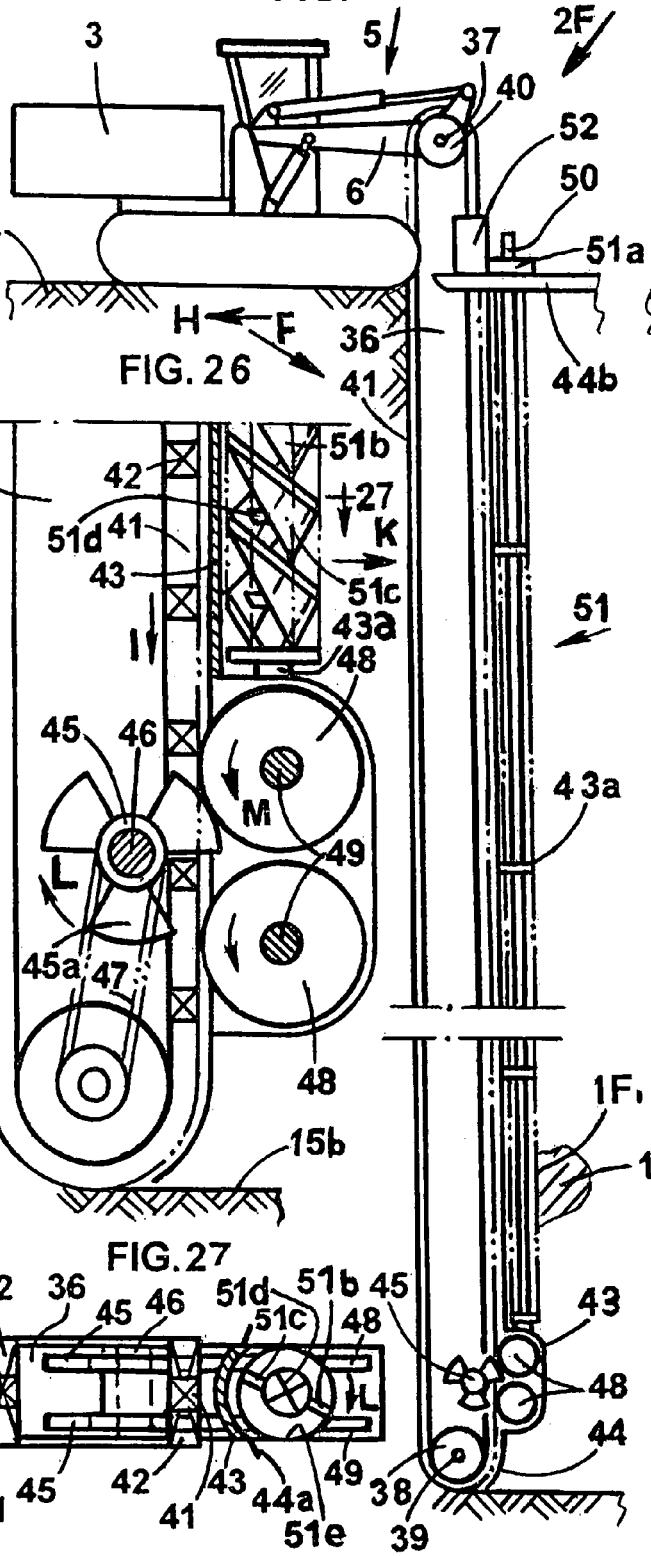
FIGS. 24, 25, 26, 27 and 27*a* are side, from the rear, partly side on a slightly enlarged scale relative to FIG. 24, cross-sectional taken on line 27-27 of FIG. 26 views of sixth preferred embodiment of the apparatus according to the invention.
Figure 25:
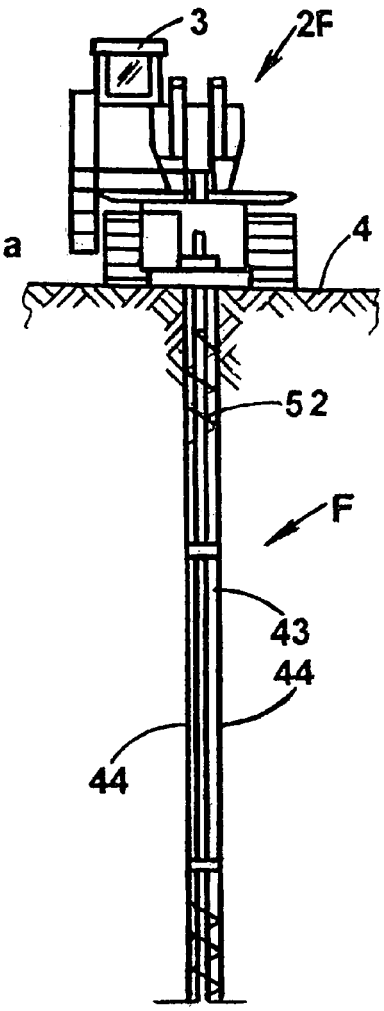

In other construction method, first, an agitator (not shown) is prepared, which is substantially similar in construction to the endless chain cutter G and includes the agitator pipe shield 59 provided on the guide post 53, the sealing packings 70 provided on the pipe shield 59 and the shield 69. The endless chain cutter G of the apparatus 2G according to the invention is placed on the ground 4. The drive hydraulic unit 66 is then moves the ski 62 into the shortened position and thereafter the chassis 3 is driven in the predetermined direction shown by an arrow H in FIG. 9*a* to advance the agitator, while the agitator is inserted into the excavated section behind the cutter G, the oscillating ski 62 is driven in the predetermined opposite directions I and J in FIG. 35*b*, and a running hardening filler material is poured through the injection pipe 73 into the section as shown by an arrow R. As a result, the bottom of the section is compacted, the section is filled with the ready filler material to form a ready filling, and a frontal working face 1$G_1$ of the ready filling is agitated and compressed to form a compacted ready filling wall 1G.

Each of Illustrated below in FIGS. 36 to 55 following embodiments of an apparatus 102 for constructing an underground continuous compacted filling structure 101 comprises a seesaw segment cutter in modifications S to V.

Figures 36, 37, 38, 39, 42, 43, 44, 45:
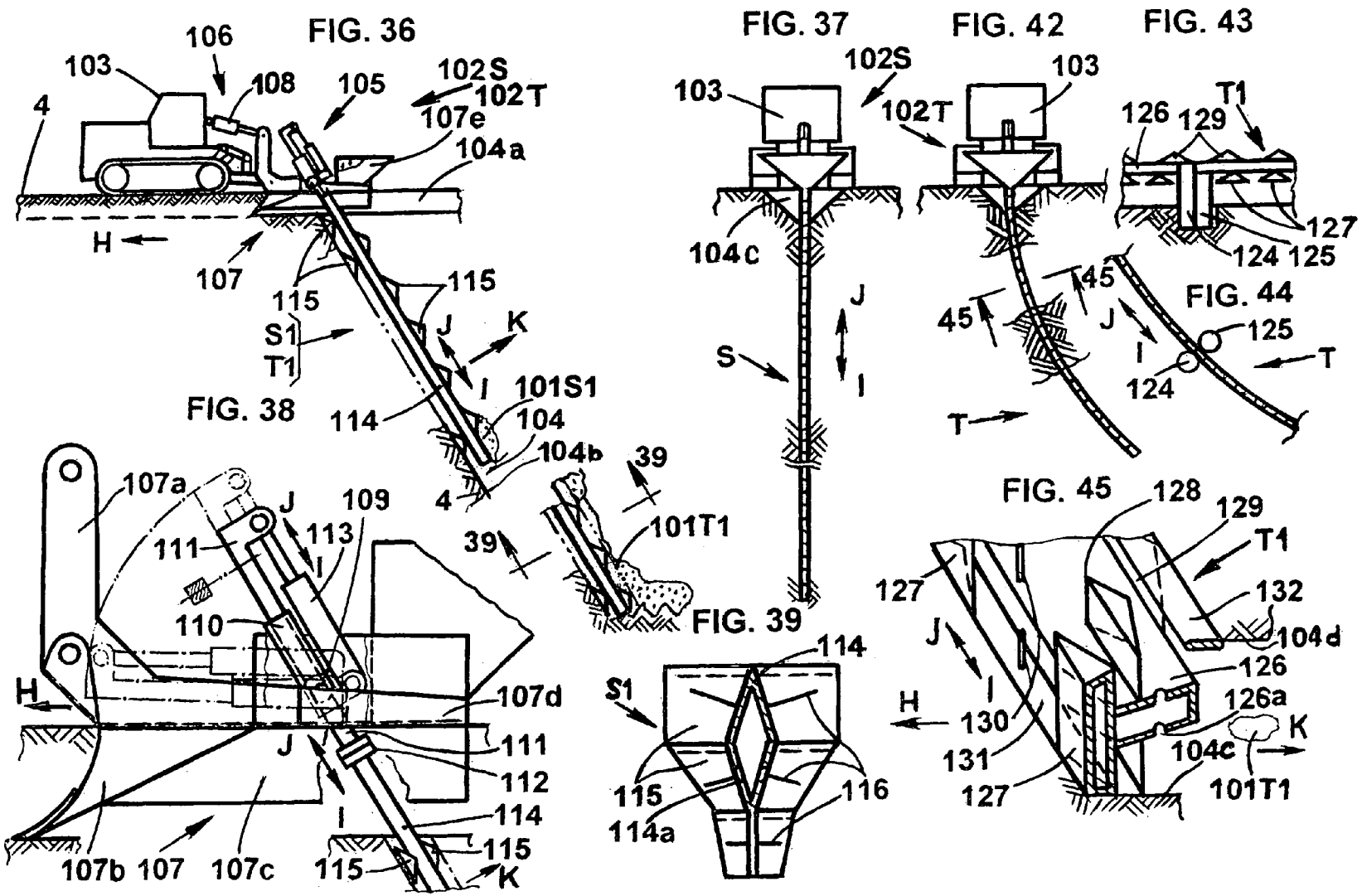
FIGS. 36 and 37 are side and from the rear views of eighth to eleventh preferred embodiments of the apparatus having rod cutters according to the invention.
FIG. 38 is a partly side view of an example of a framework used for the rod cutters in the apparatus shown in FIGS. 36 and 37 according to the invention.
FIG. 39 is a cross-sectional view taken on line 39-39 on a slightly enlarged scale relative to FIGS. 36 and 37 of one example of a rectilinear rod cutter of the eighth embodiment of the apparatus shown in FIGS. 36 to 38.
FIGS. 42, 43 and 44 are from the rear, partly side and from above views of a circular sickle-shaped rod cutter of the tenth and the eleventh embodiments.
FIG. 45 is a cross-sectional view taken on line 45-45 of FIG. 42 on a slightly enlarged scale of one example of a circular sickle-shaped rod cutter of the tenth embodiment of the apparatus shown in FIGS. 36 and 42 to 44.
Figure 47:
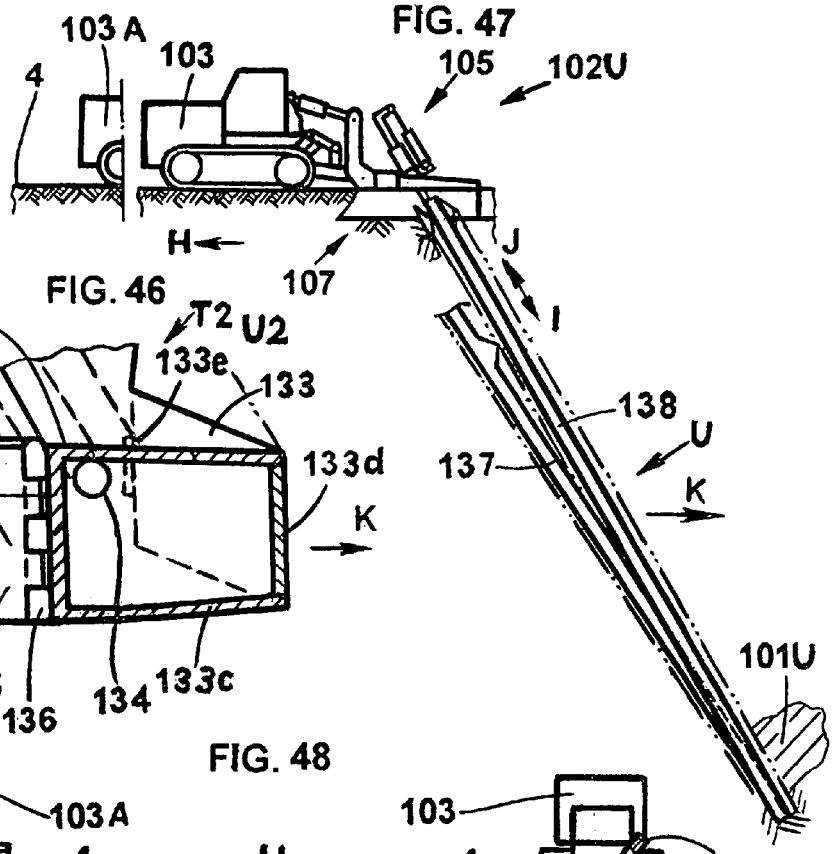
FIG. 47 is a side view of one example of a circular sweep rod cutter of a twelfth preferred embodiment of the apparatus according to the invention.

The apparatus 102 comprises generally a traveling chassis 103 such as a known caterpillar tractor movable over the ground 4 along the length of a line of the structure 101 which is to be formed in an intended advancing direction shown by an arrow H in FIGS. 36 and 47 along the length of a structure line to produce a trench-shaped excavated section 104 and the structure 101 in the section 104 being formed and for supporting the seesaw segment cutter, a supporting framework 105 including a lifting assembly 106 mounted on the chassis 103 and adapted to be transported in the intended advancing direction H over the ground 4 to support, dispose and advance the seesaw segmental cutter in the direction H, a seesaw cutter-supporting, preferably double-breasted plough-shaped ski means 107 movable in and along the length of a ditch-shaped, upper portion 104*a* of the section 104 and having an upper tilting frame 107*a*, a supporting double-breasted plough 107*b* provided with supporting ski portions 107*c*, two mould-board portions 107*d*, a hopper-doser portion 107*e* provided with a number of branched injection pipes (later described), a number of power hydraulic cylinder and piston units 108 connected between the chassis 103 and the supporting ski means 107, a ball-and-socket hinge means 109 on the supporting ski means 107, a lower tilting frame 110 supported on the ski means 107 with the hinge means 109 having a central longitudinal axis substantially similar in shape to a central longitudinal axis of the seesaw segment cutter, where the guide frame axis crossing pivotal axes of the hinge means 109, and a guide rail portion extending longitudinally (not shown) and adapted to support and guide the seesaw segment cutter, a carrier member 111 having a saddle portion for engaging on the rail portion and a lower end capable to be connected with an upper end of the appropriate seesaw segmental cutter by aid of a clutch means 112 for lateral displacement in the advancing direction H and for longitudinal reciprocation in directions shown by arrows I and J in FIGS. 36 and 38, a drive means such as a power double-acting hydraulic piston and cylinder unit or ram 113 pivotally secured to the guide frame 110 and connected via a linkage or bracket and the like to the member 111 to force or shift any above-mentioned seesaw segment cutter in the directions I and J. The upper end of the seesaw segment cutter is connected to the member 111 by the clutch means 112.

The rectilinear seesaw rod cutter S1 for forming the structure 101S1 with the excavated ground that comprises a rectilinear, injection pipe-shaped rod 114 for guiding and supporting components of the cutter S1 and having a stream-lined cross-section, a number of cutter and compressor sliders 115 fixed to the rod 114, where each of the sliders 115 has sharpened edges oriented in the directions I and J in FIGS. 36 and 38 and filling-compressing facet portions shaped into a salient oriented toward a frontal working face 101S1$_1$ of the structure 101S1 in a direction opposite to the direction H and shown by an arrow K in FIG. 38 and oriented at the back angle in relation to the directions I and J, where the back angle is equal to about 25-30°, preferably 30°; a number of agitator bars 116 fixed to the rod 114. As the forward oriented edges of the slider 115 move in the directions I and J, the ground 4 will be scraped from a leading facial wall 104*b* of the excavated section 104 and the section 104 will form. As the backward oriented in the direction K in FIGS. 36 and 38 facets of each the slider 115 move in the directions I and J, the excavated ground in the section 104 will be forced toward the direction K and then compressed on the face 101S1$_1$ so that the wall 101S1 will be formed and compressed thereof, while the rod 114 will be forced in relation to the filling being compressed toward the direction H to assist the chassis 103 to advance the rod 114 in the direction H. The injection rod pipe 114 extends from the support ski means 107 and has branched lower ends 114*a* opening at a lower end of the rod pipe 114. While the mortar is injected in the section 104, the excavated ground and the mortar will be forced by each the sliders 115 and by each of the bars 116 to be mixed together into an improved mixed ground filling and the improved ground filling on the facets of each the slider 115 that will be forced toward the direction K and the face 101S1$_1$ at behind the cutter S1 and compressed on the face 101S1$_1$ to form the wall 101S1.

In constructing an underground continuous compacted ground wall by the use of the apparatus 102S constructed described above, first a horizontal ditch portion 104*a* having predetermined sizes is dug in the ground 4 at a position where the underground continuous wall is to be formed by means of an excavating device 107 or the like. The rectilinear rod cutter S1 having a desired length is then assembled and placed in the ditch section 104*a*. Thereafter, the rod 114 of the cutter S1 is driven by means of the hydraulic unit 113 to reciprocate in directions shown by arrows I and J in FIG. 36 to form a groove in the ground 4, while the traveling chassis 103 is advanced in the direction shown by an arrow H in FIG. 36 by a chassis activating means (not shown) to form a continuous trench in the ground 4.

Figures 51, 52, 53, 54A, 54B, 54C, 55A, 55B:
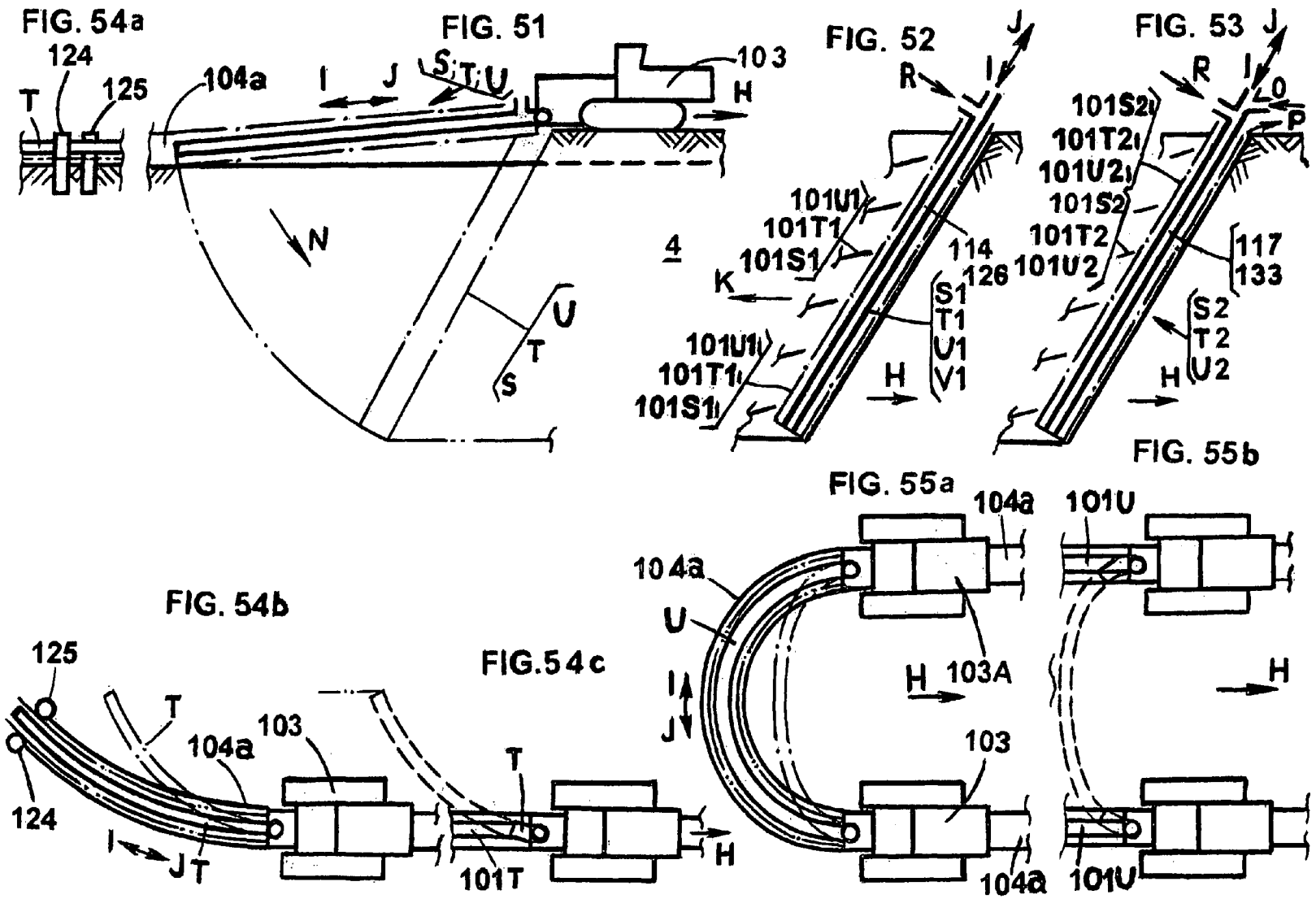
FIG. 51 is a view illustrating the processes of the first construction method according to the invention with using the eighth to thirteenth embodiments of the apparatus shown in FIGS. 36 to 48.
FIG. 52 is a view illustrating the processes of the second construction method according to the invention with using the eighth, tenth and twelfth embodiments of the apparatus shown in FIGS. 36 to 39, 42 to 45, 47 to 49*b;*
FIG. 53 is a view illustrating the processes of the third construction method according to the invention with using the ninth, eleventh and twelfth embodiments of the apparatus shown in FIGS. 36 to 38, 40 to 44, 46 to 48.
FIGS. 54*a*, 54*b* and 54*c* are a side view and plan views illustrating the processes of the fourth construction method according to the invention with using the tenth and eleventh embodiments of the apparatus shown in FIGS. 42 to 46.
FIGS. 55*a* and 55*b* are plan views illustrating the processes of the fifth construction method according to the invention with using the twelfth and thirteenth embodiments of the apparatus shown in FIGS. 45 to 48.

FIGS. 51 and 52 illustrate the first and second construction methods according to the invention. First, a ditch section 104*a* is dug in the ground 4 to predetermined sizes by means of an excavating device such as a double-breast plough 107 as shown in FIG. 36. The seesaw rectilinear rod cutter S1 of the apparatus 102S according to the invention is then inserted into the ditch section 104*a*. Thereafter the chassis 103 is driven in the predetermined direction shown by an arrow H in FIG. 51 to excavate the ground 4, while a lubricating liquid such as a water (in the first method) or a hardening improving liquid such as a cement milk (in the second method) is jetted into the excavated section 104 through the injection rod pipe 114, as shown in FIGS. 39 and 52. As a result, the lubricating or hardening liquid is mixed with the excavated ground in the section 104 to form a mixed and compacted ground wall 101S1 as shown in FIGS. 51 and 52 and a surplus of a mixture of the liquid and the excavated ground is displaced forcedly into the ditch section 104*a* to form a head of the ground structure 101S1.

Figure 41:
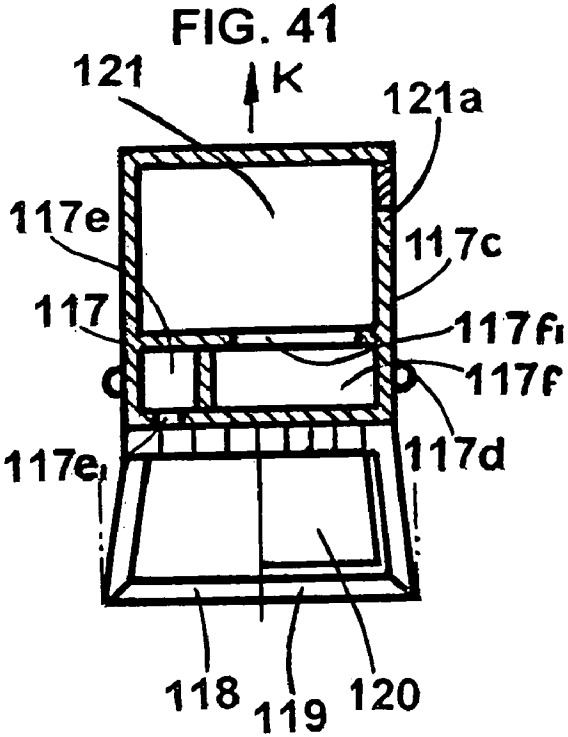
FIGS. 40 and 41 are partly side and cross-sectional taken on line 41-41 of FIG. 40 and shown on a slightly enlarged scale relative to FIGS. 36 and 37 views of a second example of a rectilinear rod cutter of the ninth embodiment shown in FIGS. 36 to 38.
Figure 40:
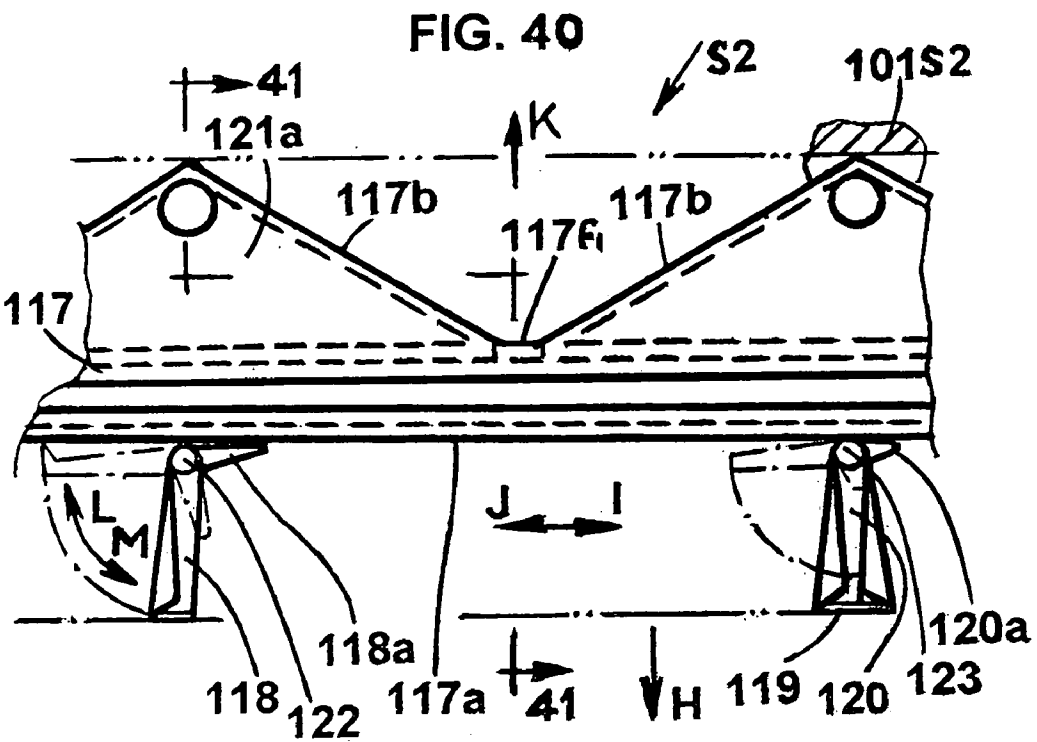

A rectilinear seesaw rod cutter S2 for constructing an underground continuous compacted filing structure 101S2 of a running, hardening ready-mixed filler material such as cement concrete that comprises an elongate, rectilinear pipe-shaped rod 117 for guiding and supporting components of the cutter S2 that having a forward, in relation to a direction shown by an arrow H in FIG. 40, oriented facet portion 117*a*, a backward oriented facet portion 117*b* and side portions 117*c*, elongate packings 117*d* provided along the length on the side portions 117*c* for sealing small gaps between the side walls of the excavated section 104 and the side portions 117*c*, a number of cutter and remover blades 118 and a number of joined cutter members 119 and removal blades 120 alternately arranged on the rod 117, whereby the portion 117*a* generates a frontal removal channel or pass way between the walls of the section 104 for guiding the excavated ground being removed. Each of the number of the blades 118 in FIGS. 40 and 41 is supported at its inner edge on the portion 117*a* by means of a hinge 122 for alternating oscillation about a generally horizontal blade pivotal axis, the blade pivotal axis being perpendicular to the central longitudinal plane of the rod 117 in the directions I and J in FIG. 40 between an operative transversal position represented by full lines in FIGS. 40 and 41 and an inoperative longitudinal position represented by chain-dotted lines in FIG. 40 and has an outer sharpened edge and aside oriented edges capable of being engaged on the side walls, an inner edge capable of being engaged on the portion 117*a*, a removal facet portion (not shown) oriented in the direction J, a plurality of bearing lug portions of the hinge 122 that are distributed co-axially, horizontally and transversally within an inner edge of the transversally widened blade 118, and a limit stopper salient portion 118*a* on the inner edge that is capable of being forced into interaction with the portion 117*a* to limit the swings of the blade 118 about the blade pivotal axis into the operative position which being perpendicular preferably to the direction J. The rod 117 has a plurality of bearing lug portions of the hinge 122 that are distributed co-axially within the widened portion 117*a*. The hinge 122 comprises an elongated bearing part such as a pin connected to the lug portions of the shield 117 and the lug portions of the blade 118. As the sharpened edge of the blade 118 disposed in the transversal operative position that moves in the direction J, the ground 4 will be scraped from the wall 104*b* and the section 104 and a filling of the excavated ground in the removal channel will be formed. As the removal facet portion of the blade 118 disposed in the transversal operative position closing off the removal channel that extends in the direction J, the excavated ground will be forced in the channel in the direction J toward above the ground 4. When the blade 118 moves in the direction I, the walls of the section 104 and the excavated ground located in the channel force the blade 118 remotely from the axis of the hinge 122 and turn the blade 118 about the axis of the hinge 122 from the transversal position into the longitudinal position to pass by the excavated ground located in the channel.

The cuter members 119 are π-shaped and rigidly secured in a transversal operative position to the portion 117*a* and have oriented in the directions I and J sharpened outer edges. A remover blade 120 is positioned inside and for engaging on the member 119 and connected to the portion 117*a* by means of a hinge 123 for alternately oscillating about a generally horizontal blade pivotal axis of the hinge 123, the blade pivotal axis being perpendicular to the central longitudinal plane of the rod 117, in the directions I and J between a transversal operative position represented by full lines in FIGS. 40 and 41 and a longitudinal inoperative position represented by chain-dotted lines in FIG. 40 and has an oriented in the direction J removing facet portion and a plurality of bearing lug portions of the hinge 123 distributed co-axially, horizontally and transversally within a transversally widened inner edge of the blade 120, and a salient spur portion capable of being forced into interaction with the portion 117*a* to limit the swinging of the blade 120 into the transversal position. The rod 117 has a plurality of bearing lug portions of the hinge 123 comprising an elongated bearing part such as a pin connected to the lug portions of the rod 117 and the lug portions of the blade 120. As the sharpened edge of the member 119 moves reciprocally in the directions I and J, the ground 4 will be scraped from the wall 104*b* and the section 104 and a filling of the excavated ground in the removal channel will be formed. As the removing facet portion of the blade 120 moves in the direction J, the excavated ground will be forced in the removal channel in the direction J to be removed toward above the ground 4. When the blade 120 moves in the direction I, the excavated ground located in the channel that forces the blade 120 remotely from the pivotal axis of the hinge 123 and turn the blade 120 about the hinge pivotal axis from the operative transversal position into the inoperative longitudinal position to permit the blade 120 to pass by the excavated ground to be removed. If the surface of ground water is located below the section 104, an injection pipe 117*e* for pouring a lubricating liquid such as water or a drilling clayey fluid extends from the hopper 107*e* into the rod 117 and has lower ends $\mathbf{117}e_1$ opening at a lower end of the rod 117 toward the blades 118 and 120.

The portion 117*b* is shaped into a number of gable roof-shaped, filling-compressing slider salients and hollows alternately distributed in consecutive order along the length of the underground portion of the rod 117 for compressing and agitating a frontal working face $\mathbf{101S2}_1$ of the ready filling wall 101S2 being formed with a running, hardening ready mortar such as a cement concrete. An injection pipe portion 117*f* of the rod 117 for pouring mortar extends from the hopper-doser 107*e* and has branched orifices $\mathbf{117}f_1$ opening at the hollows of the portion 117*b*. The hollows and salients have the back angle in relation to the central longitudinal axis of the shield 117, the back angle being equal to about 20-25°, preferably 25°. Several of the salients 117*b* and the portions 117*c* generate boxes 121 for containing a heavy weighed material such as sand or scrap iron and the like, and each of the boxes 121 has a hatch provided with a plug 121*a*. While the hardening ready mortar being injected into the section 104 behind the rod 117 being reciprocated, the section 104 will be filled, a concrete filling will be formed, each of the salients can alternately form vacuumed gaps within the adjacent hollows and ahead of the face for sucking the mortar from the injection pipe 117*f* into the gaps to fill the gaps, and then force the mortar filled the adjacent hollows by its advancing slopes on the face to form, compress and agitate the face to compact the face and form the wall 101S2. The drive means 113 can be used to assist the chassis 103 in moving up the rod 117 and with it the cutter S2 in the advancing direction H in the section 104 ahead of the face 101S2$_1$ being compressed before it has hardened.

FIGS. 51 and 53 illustrate the third construction method according to the invention. The rectilinear rod cutter S2 of the apparatus 102S according to the invention is positioned on the ground 4 and driven to reciprocate in the directions shown by arrows I and J in FIG. 51 and inserted into the ground 4 to excavate the ground 4, advance an excavated section 104 in the direction shown by an arrow N in FIG. 51, and remove the excavated ground as shown by an arrow P in FIG. 53 and the chassis 103 is driven in the predetermined direction shown by an arrow H in FIG. 51, while a hardening ready filler material is poured through an injection pipe, the injection pipe is substantially similar in construction to the rod 117, in the excavated section 104 as shown by an arrow O in FIG. 53. As a result, the excavated section 104 is filled with the hardening filler material to form a hardening filling, a frontal working face 101S2$_1$ of the hardening filling on the rear facet portion 117*b* of the rod 117 that is agitated and compressed to form a compacted concrete wall 101S2.

An embodiment 102T of the apparatus 102 comprises a number, two preferably, of paired guide rest objects or piles 124 and 125 (FIGS. 43 and 44) capable to be fixed in the ground 4 in operative positions at sides of a seesaw circular sickle rod cutter T in modifications T1 and T2 (shown later) as it is disposed in a horizontal starting operative position on the ground 4 for directing excavation of a starting circular arc-shaped groove of an excavated section 104 in the ground 4. Each of the guide piles 124 and 125 is able to force the cutter T as it being reciprocated between the piles 124 and 125 from its position toward directions shown by arrows I and J in FIG. 44 and control the direction of advancement of the starting grooves.

The cutter T1 for constructing an underground continuous compacted ground filling structure 101T1 that comprises a circular sickle-shaped rod 126 for supporting and guiding components of the cutter T1, an injection pipe which is substantially similar in construction to the rod 126 and extending down from the hopper-doser 107*e* and has branched lower ends 126*a* opening at a lower end of the rod 126, and numbers of cutter and compressor sliders 127, 128 and 129 for forming and filling the section 104 with the excavated ground, agitating and compressing the filling and a number of agitator bars 130 fixed to the rod 126, partly conical sickle ski-shaped compressor and director members 131 and 132 fixed on outer and inner, in relation to an axis of curvature of the cutter T1, ends of the sliders 127 and 129 for directing excavation and compressing side walls, a bottom 104*c* and a roof 104*d* of the section 104. The members 131 and 132 are capable of being forced into interaction with the corresponding piles 124 and 125 and then with the side walls, the bottom 104*c* and the roof 104*d* of the section 104 being formed to compress the bottom 104*c* and the roof 104*d* to secure a bedding of the ground wall 101T1 and to urge the cutter T1 in a direction crossing a tangent of the central longitudinal surface of the section 104 toward the intended circular directions I and J of reciprocation and forcing the rod 126 from its position toward the directions I and J and control the circular direction of advancement of the grooves of the section 104. Each of the members 131 and 132 has an oriented in the direction H sharpened edge and an oriented toward the bottom 104*c* or the roof 104*d*, reciprocation-directing and bottom- or roof-compressing facet portion for forcing the corresponding guide pile 124 and 125 and then the bottom 104*c* and the roof 104*d* in the crossing direction, where the edges and the facet portions of the members 131 and 132 are operable to move the cutter T1 with the members 131 and 132 relatively to the piles 124 and 125 and the bottom 104*c* and the roof 104*d* being forced toward the directions I and J by aid of the ram 113 capable of forcing the edges and facet portions of the members 131 and 132 against the piles 124 and 125, the bottom 104*c* and the roof 104*d*.

As the members 131 and 132 move relatively to and engage on the guide piles 124 and 125, the directions I and J of the circular arc-shaped grooves of the section 104 will be controlled. As the edges of the sliders 127 to 129 move in the directions I and J, the grooves and the section 104 will be formed, the bottom 104*c* and the roof 104*d* of the grooves will be compressed and the section 104 will be filled with the excavated ground. As the facet portions of the sliders 127 to 129 and the bars 130 move in the directions I and J, a filling of the excavated ground in the section 104 will be agitated to be mixed and forced laterally in a direction shown by an arrow K in FIG. 45 on a frontal working face 101T1$_1$ of the structure 101T1 being formed closely behind the cutter T1 and the face 101T1$_1$ will be agitated and compressed to form the compacted ground structure 101T1. The ram 113 can be used to assist the chassis 103 in advancing up the cutter T1. An injection pipe which is substantially similar in construction to the sickle rod 126 extends from the hopper-doser 107*e* and has branched lower ends 126*a* opening at a lower portion of the rod 126.

In constructing an underground continuous compacted filling structure 101T by the use of the apparatus 102T constructed described above, first, a ditch section 104*a* having predetermined sizes is dug in the ground 4 at a position along the length of a structure line where the underground continuous structure 101T1 is to be formed by means of a known double-breasted plough or the like as shown in FIGS. 51-54, the sickle rod cutter T1 having a desired length is assembled and placed in the ditch section 104*a*. Then the guide piles 124 and 125 having predetermined sizes are fixed in the ground 4 on each side of a middle preferably portion of the sickle rod cutter T1 by means of a known pile driver (not shown). Thereafter, the rod 126 of the cutter T1 is driven by means of the hydraulic ram 113 in directions shown by arrows I and J in FIG. 44 to form a continuous groove in the ground 4 in the direction shown by an arrow N in FIG. 51, and the chassis 103 is advanced in the direction shown by an arrow H in FIG. 51 to form a continuous elliptical trough-shaped excavation in the ground 4 downwardly and in the direction H.

FIGS. 51 and 54*a*-54*c* illustrate the first and second construction methods according to the invention by the use of the sickle rod cutter T1. First, a ditch section 104*a* having predetermined sizes is dug in the ground 4 by means of a known double-breasted plough or the like as shown in FIGS. 51-54 and the cutter T1 of the apparatus 102T1 according to the invention is positioned in the ditch section 104*a*. The guide piles 124 and 125 are then inserted to a predetermined depth and fixed in the ground 4 on each side of a middle portion of the cutter T1 as shown in FIGS. 54*a* and 54*b* by means of a pile driver (not shown). Thereafter the cutter T1 is driven in the directions shown by arrows I and J in FIG. 51 and the chassis 103 is driven in the predetermined direction shown by an arrow H in FIG. 51 to excavate the ground 4, while a lubricating liquid such as water or drilling fluid (in the first method) or an improving or hardening liquid such as clayey fluid or cement milk (in the second method) is jetted into the excavated section 104 through the injection pipe-shaped sickle rod 126. As a result, the bottom 104*c* and the roof 104*d* of the section 104 as shown in FIG. 45 are compressed into a bedding, the excavated ground is mixed with the fluid, the excavated ground (in the first method) or an improved mixture of the excavated ground and the improving liquid is compressed toward a frontal working face 101T1$_1$ of the filling 101T1, the face 101T1$_1$ is compressed and a surplus of a mixture of the liquid and the excavated ground is displaced forcedly into the ditch section 104*a* to form a compacted mixed ground (in the first method) or improved ground (in the second method) structure 101T1 as shown in FIG. 52.

Figure 46:
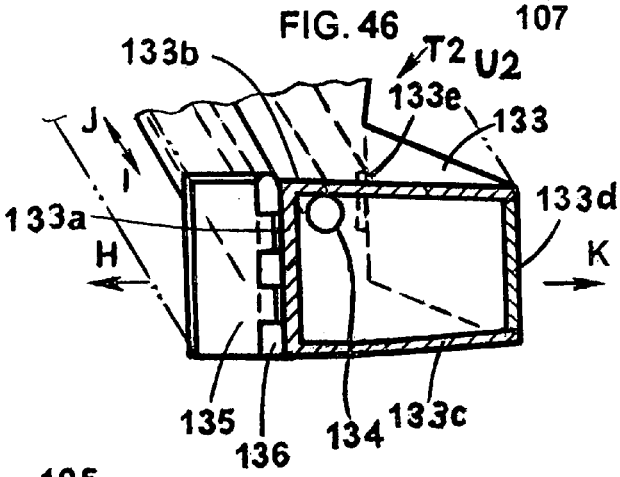
FIG. 46 is cross-sectional view taken on line 45-45 of FIG. 42 on a slightly enlarged scale views of a second example of a circular sickle-shaped rod cutter of the eleventh embodiment shown in FIGS. 36 and 42 to 44.

A circular sickle-shaped cutter T2 for constructing an underground continuous compacted filling structure 101T2 of a running, ready-mixed filler material such as a hardening cement concrete or a sand pulp that comprises an elongate, circular sickle-shaped rod 133 (FIG. 46) for supporting and guiding components of the cutter T2 and directing the excavation of circular arc-shaped grooves of the excavated section 104 being formed and having a forward oriented wall portion 133*a* generating a frontal remover channel or a pass way extending at ahead of the portion 133*a* from its lower portion toward the ground surface for guiding the excavated ground which is to be removed, an oriented toward an axis of circular curvature of the rod 133 groove-directing inner wall portion 133*b* and an oriented from the axis of circular curvature, groove-directing outer wall portion 133*c* generating lower and upper beddings for the structure 101T2 being formed, a face-compressing rear wall portion 133*d* shaped into a number of angular preferably, compressing salient sliders and hollows alternately distributed along the length of the portion 133*d* for forcing and compressing a frontal working face 101T2$_1$ of the structure 101T2 being formed with the ready-mixed filler material, where each of the salient sliders are positioned at the non-stuck back angle in relation to the tangent to the axis of circular curvature of the sickle rod 133, where the wall portions 133*a*, 133*b*, 133*c* and 133*d* generate an injection pipe 133*e* which is substantially similar in construction to the rod 133 and extending from the hopper-doser 107*e* and having a number of orifices 133*e*$_1$ opening in the hollows between the adjacent salient sliders of the portion 133*d*, where several of the wall portions 133*c* and 133*d* generate boxes for containing heavy weighed ballast materials such as sand or scrap iron and the like, where each of the boxes has a hatch provided with a plug (not shown), a number of cutter and remover blades 135 (FIG. 46) preferably similar partly in construction to the blades 118 in FIGS. 40 and 41, where each of the blades 135 is supported at its rear edge, in relation to the direction of advancement of the section 104 as shown by an arrow H in FIG. 46, by means of a blade hinge 136 on the portion 133*a* for alternating longitudinal oscillation about a pivotal axis of the blade hinge 136, the blade pivotal axis being perpendicular to a tangent plane to a central longitudinal circular cylindrical surface of the cutter T2, in directions shown by arrows I and J in FIG. 46 between a transversal operative position represented by full lines and an inoperative longitudinal position like represented by chain-dotted lines in FIG. 40 and has a frontal sharpened edge, a removing facet portion oriented in the direction J, a plurality of bearing lug portions (not shown) of the hinge 136 that are distributed co-axially about the pivotal axis of the hinge 136 and within the rear edge of the transversally widened blade 135, and a limit stopper salient spur portion on the rear edge that is capable of being forced into interaction with the sickle rod 133 to limit the oscillation of the blade 135 about the axis of the hinge 136 in a transversal operative position, where the rod 133 has a plurality of bearing lug portions of the hinge 136 that are distributed co-axially within the width of the rod 133 and the hinge 136 comprises an elongated bearing part such as a pin connected to the lug portions of the rod 133 and the lug portions of the blade 135.

The rod 133 is able to force the cutter T2 from its position toward the intended directions I and J of reciprocation and to control the direction of the excavation of the circular arc-shaped grooves of the section 104 and is capable of being forced into interaction with the guide piles 124 and 125 and then with the bottom 104*c* and the roof 104*d* of the starting grooves and the section 104 being formed to urge the cutter T2 in a direction crossing the tangent plane of the circular central longitudinal cylindrical surface of the rod 133 toward the respective direction I or J. The groove-directing portions 133*b* and 133*c* for forcing the guide piles 124 and 125 and then the bottom 104*c* and the roof 104*d* in the crossing directions that are operable to move the cutter T2, with the rod 133, relatively to the piles 124 and 125 and the bottom 104*c* and the roof 104*d* being forced toward the directions I and J and to compress the bedding bottom 104*c* and the bedding roof 104*d* and a frontal working face 101T2$_1$ of the structure 101T2 by the ram 113 capable of forcing the portions 133*b* and 133*c* against the bottom 104*c* and the roof 104*d* and the portion 133*d* against the face 101T2$_1$.

As the sharpened edge of the blade 135 disposed in the transversal operative position moves in the direction J, the ground 4 will be scraped from the facial wall 104*b* and the section 104 will be formed, the interior of the frontal channel or pass way that extending from the bottom 104*c* in the direction J toward the ground surface will be closed off and the excavated ground will be forced along the channel of the section 104 in the direction J to be removed toward above the ground 4. When the blade 135 is being returned in the direction I, the wall 104*b* and the bottom 104*c* and the roof 104*d* of the section 104 and the filling of the excavated ground located at ahead of the portion 133*a* force the blade 135 remotely from the axis of the hinge 136 and turn the blade 135 about the axis of the hinge 136 from the transversal position into the inoperative longitudinal position opening the channel for passing by the excavated ground located in the channel. While the drilling mortar such as clayey fluid being injected through the injection pipe 134 into the channel from its lower end, a mixture of the drilling liquid and the excavated ground will be formed to easy the reciprocation of the cutter T2 in the section 104 and removing the mixture. While a hardening ready mortar such as a cement concrete being injected through the injection rod pipe 133 into the section 104 at behind the cutter T2 and the injection rod pipe 133 being reciprocated in the directions I and J, the salient slider portion 133*d* reciprocates and generates the number of vacuumed gaps between the back salient slider slopes and the face 101T2$_1$ and the bottom 104*c* and the roof 104*d* so that the mortar is sucked from the injection pipe 133 into the gaps and fills the gaps, and then compressed toward the direction K on the face 101T2$_1$ adjacent to the frontal salient slider slopes and a compacted concrete wall 101T2 will be formed. The ram 113 can be used to assist the chassis 103 in advancing the cutter T2.

In constructing an underground continuous, compacted, ready filling wall 101T2 by the use of the apparatus 102T constructed described above, first, a ditch section 104*a* having predetermined sizes is dug in the ground 4 at a position along the length of a structure line where the underground continuous structure 101T2 is to be formed by means of a known double-breasted plough or the like as shown in FIGS. 51-53 and 54*a*-54*c*, the sickle rod cutter T2 having a desired length is assembled and placed in the ditch section 104*a*. Then the guide piles 124 and 125 having predetermined sizes are fixed in the ground 4 on each side of a middle preferably portion of the cutter T2 by means of a known pile driver or the like (not shown). Thereafter, the pipe rod 133 of the cutter T2 is driven by means of the ram 113 in directions shown by arrows I and J in FIG. 44 to form a circular groove in the ground in the direction shown by an arrow N in FIG. 51, and the chassis 103 is advanced in the direction shown by an arrow H in FIG. 51 to form a continuous elliptical trough-shaped excavation in the ground 4 in the direction H.

FIGS. 51, 53 and 54*a*-54*c* illustrate the third construction method according to the invention by the use of the apparatus 102T2. First, a ditch section 104*a* having predetermined sizes is dug in the ground 4 by means of a known double-breasted plough or the like as shown in FIGS. 38 and 42. The sickle rod cutter T2 of the apparatus 102T2 according to the invention is then inserted into the ditch section 104*a*. The guide piles 124 and 125 are then inserted to a predetermined depth and fixed in the ground 4 on each side of a middle preferably portion of the cutter T2 as shown in FIGS. 54*a* and 54*b* by means of a pile driver (not shown). Thereafter the cutter T2 is driven in the directions shown by arrows I and J in FIG. 51 and the chassis 103 is driven in the predetermined direction shown by an arrow H in FIG. 51 to excavate the ground 4 and remove the excavated ground as shown by an arrow P in FIG. 53, while a running ready filler material such as a sand pulp or a cement concrete mortar is poured through the injection rod pipe 133 into the excavated section 104 as shown by an arrow O in FIG. 53. As a result, the excavated section 104 is filled with the material, a filling of the ready-mixed material is compressed on a frontal working face 101T2$_1$ of a structure 101T2 to form the compacted structure 101T2.

An apparatus 102U for constructing an underground continuous, elliptical trough-shaped, compacted filling structure 101U including adjacent a middle horizontal stratum section and from its each side wall sections sloped upward that comprises (FIGS. 47 and 48) the same preferably chassises 103 and 103A movable over the ground 104 along the length of two structure lines of the structure 101U which is to be formed, the lines extending remotely with a predetermined span distance in advancing directions shown by an arrow H in FIG. 47, supporting frameworks 105, lifting assemblies 106 mounted on the chassis 103 and 103A to support, dispose and advance the seesaw sweep cutter U in the direction H, seesaw cutter-supporting, preferably double-breasted plough-shaped ski means 107, a number of power hydraulic cylinder and piston units 108, ball-and-socket hinge means 109 on the supporting ski means 107, lower tilting frame 110 supported on the ski means 107 with the hinge means 109 having a central longitudinal axis substantially similar in shape to a central longitudinal axis of a compacted walls and stratum-forming circular arc-shaped, seesaw rod cutter U (shown later) which is partly similar in construction to the circular sickle rod cutter T shown in FIGS. 36 and 42-46 and adapted to be disposed between the chassises 103 and 103A and extend down into the ground 104 from the frameworks 105, carrier members 111, clutch means 112, where the cutter U is connected to the members 111 at its opposite ends, drive rams 113 to force or shift the cutter U in the directions I and J, a known means (not shown) for measuring the positions of the rams 113 and the chassises 103 and 103A and determining when to operate multiple activating means to effect further advancement of the groove in the predetermined advancing direction H.

The circular sweep seesaw cutter U in a first preferable modification U1 is similar partly in construction and operating to the sickle rod cutter T1 as shown in FIGS. 36 and 42-45 and comprises a circular sweep, injection pipe-shaped rod 137 for guiding and supporting components of the cutter U1 that being connected by aid of its forward, in relation to the direction H, oriented ends to the same preferably carrier members 111 of the frameworks 105 on the chassises 103 and 103A, the rod 137 is similar partly in construction to the sickle injection pipe-shaped rod 126 and a number of cutter, agitator and compressor sliders substantially similar in construction to the cutter, agitator and compressor sliders 127 to 129 of the cutter T1 shown in FIG. 45.

The sweep rod cutter U in a second preferable modification U2 is similar partly in construction and operating to the sickle rod cutter T2 as shown in FIGS. 42 and 46 and comprises a circular sweep, injection pipe-shaped rod 138 for guiding and supporting components of the cutter U2 similar partly in construction to the sickle injection pipe-shaped rod 133 shown in FIG. 46 and a number of cutter members, remover blades and hinges which are substantially similar in construction and operating to the cutter and remover blades 118 on the hinges 122, the cutter members 119 and the remover blades 120 on the hinges 123 of the sickle rod cutter T2 shown in FIGS. 40 and 41.

Figure 48:
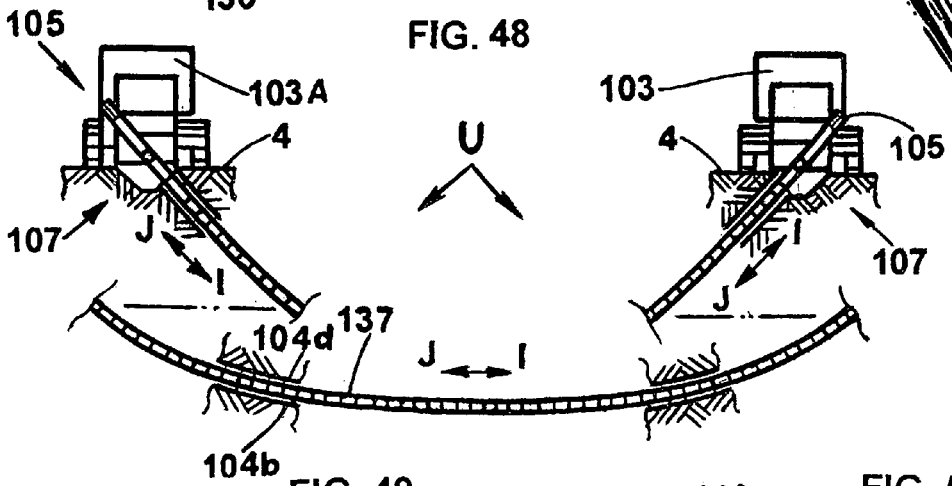
FIG. 48 is a from the rear view of the apparatus shown in FIGS. 46 and 47.
Figure 49:
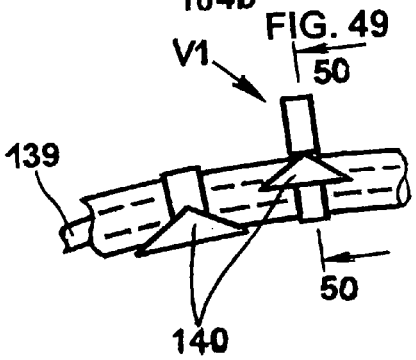
FIGS. 49 and 50 are plan, side and cross-sectional taken on line 50-50 in FIG. 49 on a slightly enlarged scale views of one example of a sweep cutter of a thirteenth preferred embodiment shown in FIGS. 47 and 48 according to the invention.
Figure 49:
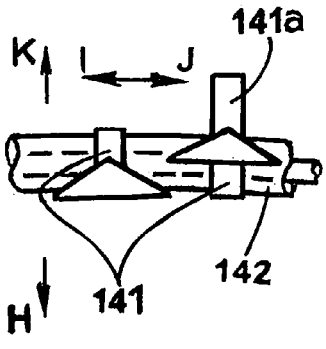
Figure 50:
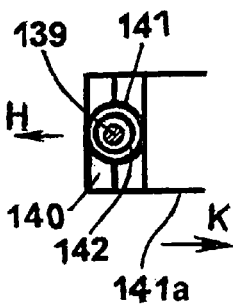

In constructing an underground continuous compacted ready filling structure 101U by the use of the apparatus 102U in the modifications 102U1 and 102U2 constructed described above, first, ditch sections 104*a* having predetermined sizes are dug in the ground 4 at positions where the underground continuous structure 101U is to be begun and formed along the length of the structure lines by means of a known double-breasted plough or the like as shown in FIGS. 38, 47 and 48, the circular sweep rod cutter U having a desired length is assembled and placed in the ditch section 104*a* between the structure lines. Thereafter, the sweep rod 137 of the cutter U1 or the sweep rod 138 of the cutter U2 is driven by means of the hydraulic rams 113 in directions shown by arrows I and J in FIGS. 47 and 48, the rams 113 being controlled by the position-measuring means, to form a circular groove in the ground 4 in the direction shown by an arrow N in FIG. 51 and compressing side walls, a bottom 104*c* and a roof 104*d* of the circular groove, and the traveling chassises 103 and 103A are advanced in the directions shown by an arrow H in FIGS. 55*a* and 55*b* to form a continuous, semi-elliptical trough-shaped excavation in the ground 4 in the direction H and constructing a compacted, elliptical trough-shaped filling structure 101U1 or 101U2 by the above depicted three methods.

FIGS. 51, 55*a* and 55*b* illustrate the fourth construction method according to the invention. First, a ditch section 104*a* is dug in the ground 4 to predetermined sizes by means of an excavating device such as a double-breast plough 107 as shown in FIGS. 38, 47. The seesaw circular sweep rod cutter U of the excavator 102U in appropriate modification U1 or U2 according to the invention is then inserted into the ditch section 104*a*. Thereafter the chassises 103 and 103A are driven in the predetermined directions shown by an arrow H in FIGS. 55*a* and 55*b* to excavate the ground 4, a well-known suitable measuring means such as interacting an emitter and an emitter-locator provided on the used chassises 103 and 103A is operated to remotely exploring their relative positions and a well-known suitable measuring means provided on the frameworks on the used chassises 103 and 103A are operated to exploring positions of the driving rams 113 to determine when to operate the multiple activating means of the used chassises 103 and 103A to effect further advancement of the excavated section, while predetermined running drilling and filler materials such as a drilling clayey fluid and a ready-mixed cement mortar are jetted into the excavated section through the appropriate injection pipes 133 and 134 provided in the rod 133 of the cutter U. As a result, the excavated section is formed and filled with the intended filler material, a filling of the intended filler material is compressed toward or on a frontal working face 101$U_1$ of a compacted filling structure 101U being formed to form the compacted filling structure 101U.

An embodiment 102V of the apparatus 102 for constructing an underground, continuous trough-shaped compacted filling structure 101V that is similar partly in construction to the embodiment 102U and comprises as shown in FIGS. 47 and 48 the chassises 103 and 103A each movable over the ground 4 along the length of two structure lines and provided with the same preferably framework 105, supporting and driving ski means 107, a number of power hydraulic cylinder and piston units 108, ball-and-socket hinge means 109 on the supporting ski means 107, lower tilting frame 110 supported on the ski means 107 with the hinge means 109, carrier members 111, clutch means 112, where the cutter V is connected to the members 111 at its opposite ends, a number of the drive rams 113 to force or shift the cutter V in the directions I and J, a known means (not shown) for measuring the positions of the rams 113 and the chassises 103 and 103A and determining when to operate multiple activating means to effect further advancement of the groove in the predetermined advancing direction H, and a flexible sweep-shaped, ground filling-agitator and compressor seesaw sweep cutter V disposed between the chassises 103 and 103A and adapted to extend down into the ground 104 from the frameworks 105.

The modification V1 of the flexible seesaw sweep cutter V for constructing an underground continuous, compacted, improved ground stratum and walls 101V1 comprises (FIGS. 49 and 50) a flexible sweep segment member such as a segment chain or rope member 139 for supporting and guiding components of the cutter V that is connected with its ends to the members 111 of the ski means 107 of the chassises 103 and 103A and extending along the length of a cross section of the structure 101V1, a plurality of cutter members, a plurality of agitator members, a plurality of compressor sliders (not shown) and a plurality of combined cutter, agitator and compressor sliders 140 which are similar partly in construction to the sliders 127, 128 and 129 shown in FIG. 45, arranged on the member 139 by means of base yokes 141. Each of the sliders 140 is able to force the member 139 from its position to be oriented toward the intended advancing direction shown by an arrow H in FIGS. 47 and 49 and control the orientation of the cutter V1 toward the predetermined direction H of the advancement of the excavated section 104 and capable of being forced into interaction with side walls, a bottom 104*c* and a roof 104*d* of the section 104 being formed and shown in FIG. 45 to urge the cutter V1 to turn about a central longitudinal axis of the member 139 in a direction toward the intended advancing direction H and has a sweep cutter-directing portion 141*a* for forcing the bottom 104*c* and the roof 104*d* in the directions shown by arrows W and X in FIG. 50, the portions 141*a* being remote from the central rope axis, where the portions 141*a* are operable to turn the cutter V1 relatively to the bottom 104*c* and the roof 104*d* being forced toward the advancing direction H by the rams 113 capable of forcing the portions 141*a* against the bottom 104*c* and the roof 104*d*. The cutter V1 takes up an operative position to be inclined from the direction H backward at a predetermined frontal angle, the angle is equal to about 60-80° form a continuous trough-shaped groove in the ground 4.

A flexible injection pipe such as a close-coiled spring 143 for pouring a running filler material such as a lubricating water or drilling clayey fluid or an ground-improving liquid such as a hardening cement milk that extends from the hopper-doser 107*e* of the chassis 103 up to the hopper-doser 107*e* of the chassis 103A and co-axially around preferably the rope member 139 and has orifices 143*a* opening at a lower, middle preferably, portion of the member 139.

The apparatus 102V is comprises a means such as a known ultrasonoscope and the like for remotely measuring hydrogeological characteristics of the ground 4 and determining when to operate multiple activating means of the chassises 103 and 103A to effect changing the depth of excavating the ground 4 for further advancement of the excavated section 104 in the more favourable hydrogeological conditions, for example, pass by a buried large stone which comes across in the ground 4.

In constructing an underground continuous compacted, improved ground filling structure 101V1 by the use of the apparatus 102V in the modification 102V1 constructed described above, first, a ditch section 104*a* having predetermined sizes is dug in the ground 4 at a position between and perpendicularly and along the length of the structure lines where the structure 101V1 is to be begun and formed by means of the double-breasted plough 107 or the like as shown in FIG. 38, the seesaw sweep cutter V having a desired length is assembled and placed in the perpendicular ditch section 104*a*. Thereafter, the rope member 139 of the sweep rope cutter V1 is driven by means of the hydraulic rams 113 on the chassises 103 and 103A in directions shown by arrows I and J in FIGS. 49 and 50 to form a trough groove in the ground 4 in the direction shown by an arrow N in FIG. 51 and the chassises 103 and 103A are advanced in the directions shown by an arrow H in FIGS. 56*a* and 56*b* to form a continuous semi-oval trough-shaped excavation in the ground 4.

Figure 56A:
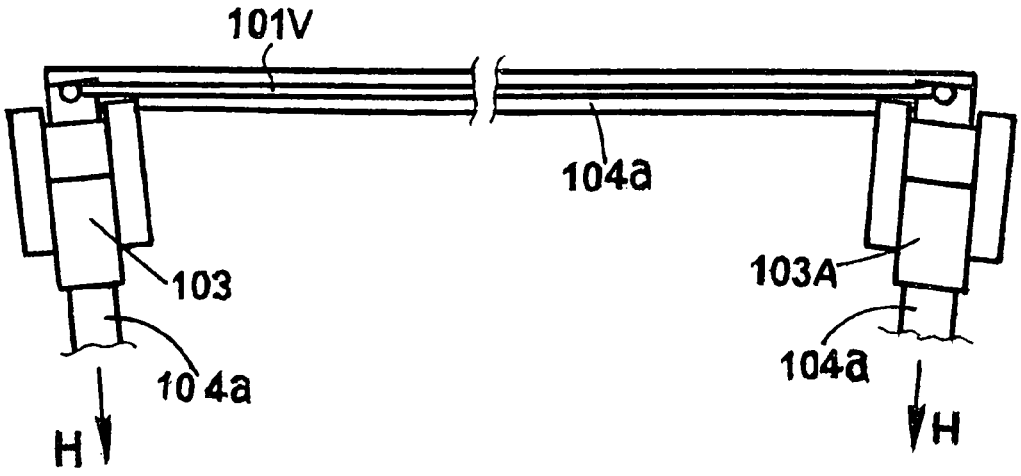
FIGS. 56*a*, 56*b* are plan views illustrating the processes of the sixth construction method according to the invention with using the fourteenth embodiment of the of the apparatus shown in FIGS. 49 and 50.
Figure 56B:
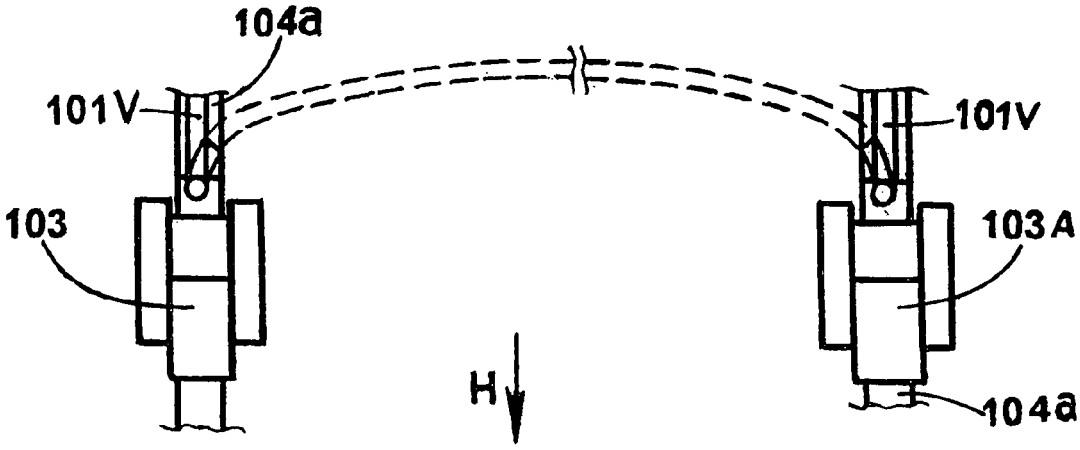

FIGS. 56*a* and 56*b* illustrate the sixth construction method according to the invention. First, a ditch section 104*a* is dug in the ground 4 to predetermined sizes by means of a trencher or a double-breast plough 107 as shown in FIG. 38. The seesaw sweep rope cutter V of the apparatus 102V according to the invention is then inserted into the ditch section 104*a* and a well-known suitable measuring means such as interacting, satellite-based locators provided on the used chassises 103 and 103A to remotely exploring their relative positions and a suitable measuring means to exploring positions of the driving rams 113 are operated to determine when to operate the multiple activating means of the used chassises 103 and 103A to effect further advancement of the excavated section. Thereafter the chassis 103 and the chassis 103A are driven in the predetermined directions shown by an arrow H in FIGS. 56*a* and 56*b* to excavate the ground 4, while a liquid improving material such as a lubricating clayey fluid or a hardening cement milk is jetted into the excavated section through the injection pipe 142 provided in the cutter V1 as shown in FIG. 52. As a result, the fluid is mixed with the excavated ground in the excavated section to form an improved ground filling, the improved ground filling is compressed toward a frontal working face 101V1$_1$ of a compacted, improved ground structure 101V1 being formed to form the compacted and improved ground structure 101V1.

These examples of the use of the apparatuses and the methods for constructing the underground, continuous, compacted filling walls and stratums show that there is possible to accomplish the both above-mentioned objects. An embodiment of the apparatus, dimensions of an useful filling-compressing cutter, a required depth of the excavation may be varied depending on a purpose for which the structure and the apparatus are to be adapted and on the properties of the ground. Such apparatuses may act accordingly to the present invention and form in the preferably non-rocky grounds any predetermined compacted filling cut-off, impervious and retaining or water-draining screen walls and trough-shaped stratums of a thickness of about 0.2 to 0.5 meters (0.2-0.3 meters mainly) and of the depth up to 12-15 meters for the endless chain cutter and to 100 meters for seesaw rod and rope cutters according to the invention. The filling-compressing cutters of the apparatus may be interchangeable depending on conditions of the ground. In one's capacity as a filler material may be used a waterproof sealing clay-cement mortar or water-permeable sand as pulp. As the chassis may be used conventional suitable tractors and chassises of known endless chain apparatuses and any conventional equipment for preparing drilling, draining and sealing filler and improving materials and for feeding that materials into the compressor cutter and a known means for remotely controlling positions of the interacting chassises and drive means and exploring the better hydrogeological characteristics of the ground.

We claim as our invention:

1. An apparatus for constructing an underground compacted, continuous filling wall and stratum structure in a slot excavation, the apparatus comprising:

a chassis for transporting a means for constructing an underground compacted filling wall and stratum structure, the chassis movable along the length of a structure line in an intended advancing direction over the ground to form the structure which extends in that direction in a section of the slot excavation;

a transportable framework mounted on the chassis and adapted to connect the chassis to the constructing means, support, dispose, and move the constructing means in the direction to form the structure;

the constructing means comprising:

an inclinely disposed, elongate motive rod;

a number of cutter bits and a number of ground earth filling—compressing, short, gabble roofs—shaping, slide able cutter and compressor blades arranged alternately on the rod to form a rod digger adapted to extend down into the ground from the framework and supported on the framework for alternating downward and upward longitudinal reciprocation;

an activating drive means for producing the alternating downward and upward longitudinal reciprocation of the rod digger;

where each of the number of the blades is capable of being forced into interaction with a filling of the section and with a front working face of the filling structure being formed in the section to force the filling and the face in a generally backward compressing direction that being opposite to the advancing direction, and to urge the rod digger in the advancing direction;

where each of the number of the blades has a compacted filling structure-forming portion for forcing the filling in the generally backward direction and includes opposite cutting edge portions, a backward and toward the face-oriented ridge portion, and opposite gabble roof slopes—shaping, compressing slider facet portions;

where the edge portions are operable to excavate the ground and the facet portions are operable to move the excavated ground earth in the generally backward direction, and to move the rod digger, with the blades, in the advancing direction relative to the filling being forced by the activating drive means capable of forcing the edge portions against a front working wall of the section and forcing the facet portions against the filling;

so that the cutter bits and the edge portions excavate the ground, form the slot section, and fill the section with the excavated ground earth, and the opposite slope facet portions alternately compress the earth filling in the generally backward direction toward and on the face of the soil structure being formed in the advancing direction, and the rod is forced with the blades in the advancing direction by the resistance of the face to compression to assist the chassis and the framework to form a further section of the slot excavation being formed as the framework is transported in the advancing direction.

2. The apparatus according to claim 1, wherein the rod digger is shaped into a circular sickle to form a sickle rod digger supported for alternating downward and upward longitudinal reciprocation in the circular directions about an axis of the circular curvature and has inner and outer, co-axial in relation to the axis of the curvature, circular cylindrical, transversal slot excavation section—directing skis fixed on corresponding inner and outer ends of each of the number of the slider blades;

where the skis are capable of being forced into interaction with guide objects positioned motionless on each side of the sickle rod digger disposed horizontally in a starting operative position on the ground surface, and with walls of a transversal, in relation to the advancing direction, excavated slot section being formed to urge the sickle rod digger from its position in directions crossing the central circular longitudinal axis of the transversal section toward the intended circular directions of the alternating downward and upward longitudinal reciprocation and control the directions of the advancement of the circular arc-shaped transversal excavated slot sections, and have corresponding inward and outward oriented, in relation to the axis, transversal sections—directing, circular cylindrical ski facet portions for forcing in the crossing directions the corresponding inner and outer objects and side walls of the transversal slot section being formed;

where the ski portions are operable to move the sickle rod digger, with the skis, relatively to the objects and the side walls being forced toward the circular directions of the alternating downward and upward longitudinal reciprocation by the activating drive means capable of forcing the ski portions against the objects and the walls.

3. The apparatus according to claim 1, wherein the framework comprises a trapezoidal prismatic ski member for supporting the activating drive means on a bottom and side walls of a ditch dug along the length of the structure line.

4. The apparatus according to claim 1, wherein numbers of the cutter bits and numbers of compactor blades are arranged on the motive rod in a plurality of groups according to the plurality of the predetermined stratums of the stratified ground to be excavated separately;

where each of the number of the grouped bits and each of the number of the grouped blades is capable of being forced into interaction with a predetermined stratum portion of a stratified front working wall of the excavated section and forming a corresponding stratum of the filling, and each of the number of the grouped blades is capable of being forced into interaction with the corresponding stratum portions of the stratified filling and the stratified face of the filling structure; and where each of the numbers of the grouped bits and each of the numbers of the grouped blades has a slot excavation-forming portion for forcing the predetermined stratums of the front stratified wall of the slot excavation and the stratified filling;

where the portions of the grouped bits and the portions of the grouped blades are operable to excavate the predetermined ground stratums, and fill each of predetermined level portions of the slot excavation with the predetermined excavated stratum earth, and move and compress the predetermined filling stratums to form a stratified compacted soil structure.

5. The apparatus according to claim 4, wherein the grouped rod digger comprises a plurality of injection pipes, each of the pipes extending from the framework into the motive rod and having branched ends distributed along each of the lengths of the plurality of portions of the rod capable to be positioned at the predetermined ground stratums.

6. The apparatus according to claim 2, wherein the sickle rod digger comprises lower and upper, transversal slot excavation section-directing skis fixed on the corresponding lowest and highest portions and along the length of the sickle rod digger;

where the skis are capable of being forced into interaction with side walls of a front slot section being formed to urge the sickle rod digger from its position in directions crossing the central longitudinal axis of the transversal section toward the intended directions of the alternating downward and upward longitudinal reciprocation, and have corresponding inward and outward oriented, in relation to the axis, transversal slot sections—directing ski facet portions for forcing in the crossing directions the corresponding lower and upper side walls of the transversal slot section being formed;

where the ski portions are operable to move the sickle rod digger, with the skis, relatively to the side walls being forced toward the compressing directions of the alternating downward and upward longitudinal reciprocation by these activating drive means capable of forcing the ski portions against the walls.

7. An apparatus for constructing an underground continuous, compacted filling wall and stratum structure in a slot excavation, the apparatus comprising:

a chassis for transporting a means for constructing an underground compacted filling wall and stratum structure, the chassis movable along the length of a structure line in an intended advancing direction over the ground to form the structure which extends in that direction in the slot excavation;

a transportable framework mounted on the chassis and adapted to connect the chassis to the constructing means, support, dispose, and move the constructing means in the direction to form the structure;

the constructing means comprising:

a disposed inclinely at a suitable acute angle, in relation to the horizontal plane, elongate, front working face of the filling structure—supporting and compressing slider shield rod provided with a sealing resilient means on its side and lower edge portions for engaging on side walls and a bottom of the excavated slot section, and a number of intended, slot excavation—forming, short cutter blades arranged on the shield from beneath and front to form a shield rod digger adapted to extend down into the ground from the framework and across the section;

a means supporting the shield on the framework for alternating downward and upward longitudinal reciprocation;

where each of the blades has opposite inner, adjacent to the shield rod, edge portion and upward oriented outer cutting edge portion and opposite facet portions extending between the edge portions, and is supported on the shield at the inner edge portion for alternating downward and upward oscillation about a generally horizontal pivot axis, the axis being within the inner edge portion and the shield rod and perpendicular to the central longitudinal surface of the shield rod and to the advancing direction, between limit stops securing a non-working longitudinal position of the blade closely along the shield rod and a working transversal position in relation to the shield rod;

an activating drive means for producing the alternating downward and upward longitudinal reciprocation of the rod shield digger and pivoting of the blades;

where the shield has a backward oriented, in relation to the advancing direction, filling face—supporting and agitating, and digger—propelling facet portion;

where the activating drive means is capable of effecting with the shield rod the alternating downward and upward oscillation of each of the blades about the generally horizontal pivot axis, so that the forward and upward oriented cutting edge portion of each of the blades excavates the ground to form a section of the slot excavation and turns the blade about the pivot axis into the transversal working position and the upward oriented facet portion removes the excavated ground earth located above and ahead of the blade over a front working wall of the slot excavation toward the surface of the ground, and alternately the blade is turned about the pivot axis by the resistance of the ground earth being stopped by the friction resistance on the front wall at behind and below the blade into the longitudinal non-working position and passes downward by and above the ground earth which staying motionless at below the blade.

8. The apparatus according to claim 7, wherein the slider facet portion has a number of gabble roof-shaping salients for forcing the face in the generally backward direction and forcing the shield digger in the advancing direction;

where each of the saliences has a central ridge portion oriented backward and transversally to the compressing directions of the alternating downward and upward longitudinal reciprocation and opposite slider slope portions and is operable to compact the face in the generally backward direction and to move forcedly the shield digger, with the shield salients, relative to the face being compressed, in the advancing direction by the activating drive means capable of forcing the salient portions against the face, so that the salient portions of the shield alternately compress and retreat from the face to form the compacted soil filling structure and continuously assist the chassis to transport the framework and the shield digger to form a further section of the slot excavation in the advancing direction.

9. The apparatus according to claim 8, wherein the shield digger comprises a plurality of injection pipes, each of the pipes extending from the framework into the shield and having branched lower ends opening at the grouped hollows between the grouped adjacent salients;

where the opposite, backward oriented, in relation to the advancing direction of the alternating downward and upward reciprocation, slope facet portions are operable to form alternately zones of relative lower pressure between the backward oriented slope facet portions and the face and to suck each of the plurality of intended ready filler mortars from the grouped pipe ends into the zones being formed to form a stratified ready filling structure, and the forward oriented slope facet portions are operable to compact the faces of the stratified ready filling in the section.

10. The apparatus according to claim 7, wherein the shield is shaped into a circular about an axis of curvature, the axis of curvature being parallel to the advancing direction, sickle to form a sickle shield digger supported for alternating downward and upward longitudinal reciprocation in the circular directions about the horizontal axis and having co-axial, in relation to the axis, circular cylindrical sickle-shaped, transversal excavation slot section—directing slider edge portions;

where the directing slider sickle edge portions are capable of forcing the sickle shield from its position toward and control the intended circular directions of the alternating downward and upward longitudinal reciprocation and capable of being forced into interaction with fixed guide objects positioned oppositely at each side of the sickle shield digger disposed horizontally in a starting operative position on the ground surface, and with side walls of transversal, circular cylindrical portion of the slot excavation being formed to urge the sickle shield digger in directions crossing a central longitudinal axis of the transversal excavated slot section toward the intended circular directions of the alternating downward and upward longitudinal reciprocation, and have corresponding inward and outward oriented, in relation to the axis of curvature, transversal slot sections—directing slider edge facet portions for forcing in crossing directions the corresponding inner and outer guide objects and the inner and outer side walls of the slot section being formed;

where the directing slider edge facet portions are operable to move the sickle shield digger, with the directing edge facet portions, relatively to the objects and the side walls being forced toward the circular directions by the activating drive means capable of forcing the directing slider edge facet portions against the objects and the walls.

11. An apparatus for constructing an underground continuous, compacted filling walls and stratum structure in a slot excavation, the apparatus comprising:

first and second paired traveling chassises positioned on the ground distantly on a number of intended lines of a filling structure and movable along the number of the lines in intended directions to produce the structure that extends in an intended advancing direction in a section of a slot excavation being formed in the advancing direction;

first and second supporting frameworks mounted on the corresponding first and second chassises and transportable along the number of the lines to produce the structure;

an elongate, sweep able motive rod extending from and between the frameworks;

a number of cutter bits and a number of cutter blades and a number of compressor blades alternately arranged on the rod to form a compacted filling structure—forming sweep able rod digger adapted to extend down into the ground from and between the frameworks;

a means supporting the first end of the sweep able rod digger on the first framework for alternating downward and upward longitudinal reciprocation, a means supporting the second end of the sweep able rod on the second framework for the alternating downward and upward longitudinal reciprocation;

a first activating drive means on the first framework for producing the alternating downward and upward longitudinal reciprocation of the sweep digger;

a second activating drive means on the second framework for producing the alternating longitudinal reciprocation of the sweep able digger in accordance with the first drive means to form a semi-cylindrical, compacted, wall and stratum filling structure;

a first means for measuring positions of the first supporting means and the first activating drive means in relation to the first framework and a second means for measuring positions of the second supporting means and the second activating drive means in relation to the second framework and determining when to operate multiple activating means of the apparatus to effect further advancement of the structure.

12. The apparatus according to claim 11, wherein the semicircular sweep rod is shaped into a shield;

provided with a number of slot excavation—forming, short cutter blades arranged on the shield from beneath and front to form a semicircular sweep shield digger;

where each of the blades has opposite inner, adjacent to the shield, edge portion and upward oriented outer cutting edge portion and opposite facet portions extending between the edge portions, and is supported on the shield at the inner edge portion for alternating downward and upward oscillation about a generally horizontal pivot axis, the axis being within the inner edge portion and the shield and perpendicular to the central longitudinal surface of the shield and to the advancing direction, between limit stops securing a non-working longitudinal position of the blade closely along the shield and a working transversal position in relation to the shield;

where the shield has a backward oriented, in relation to the advancing direction filling face—supporting and agitating, and digger-propelling facet portion which is operable by the activating drive means capable of effecting with the shield the alternating downward and upward oscillation of each of the blades about the pivot axis, so that the forward and upward oriented cutting edge portion of each of the blades excavates the ground to form a section of the slot excavation and turns the blade about the pivot axis into the transversal working position, and the upward oriented facet portion removes the excavated ground earth located above and ahead of the blade and over a front working wall of the slot excavation toward the surface of the ground, and alternately the blade is turned about the pivot axis by the resistance of the ground earth being stopped by the friction resistance on the front wall at behind and below the blade into the longitudinal non-working position and passes downward by and above the ground earth which staying motionless at below the blade.

13. The apparatus according to claim 11, wherein the sweep rod digger comprises a plurality of injection pipes, each injection pipe extending from the first and second frameworks into the sweep motive rod and having branched orifices opening at the middle portion and along the lengths of intended portions of the sweep rod.

14. The apparatus according to claim 11, wherein the rod digger comprises a sweep able motive rod having the ability of being swept into a sweep shape from a straight shape and is capable of constructing a filling wall structure in a slot trench being formed beneath the line in the downward direction by means of the first and second activating drive means of the first and second paired traveling chassises movable along the intended structure line to meet.

15. The apparatus according to claim 11, wherein the first chassis is movable along a left intended structure line and the second chassis is movable along the length of a right intended structure line in the intended advancing directions to produce a compacted walls and stratum filling structure in a semi-cylindrical slot excavation being formed along the lengths of the lines in the directions.

16. The apparatus according to claim 15, wherein the rod is shaped into a semi-circular motive rod about an axis, the axis being perpendicular to the plane of the semi-circular rod, to form a semi-circular rod digger;

the first supporting means is capable of guiding the first end of the semi-circular rod digger for alternating downward and upward longitudinal reciprocation in the circular directions;

the second supporting means is capable of guiding the second end of the semi-circular sweep digger for the alternating downward and upward longitudinal reciprocation in the circular directions.

17. A method for construction of an underground continuous, compacted soil filling structure in a slot excavation, the method utilizing an apparatus comprising:

a traveling chassis movable along the length of a structure line in an intended advancing direction over the ground to form the structure which extends in that direction;

a transportable connecting framework mounted on the chassis and adapted to connect the chassis to a filling structure—constructing means of the apparatus and to dispose and advance the constructing means in the direction;

the constructing means adapted to extend down into the ground from the frameworks up to a predetermined depth toward and in the intended direction to excavate a section of the slot excavation along the length of the line to lay excavated ground earths in the excavated slot section, and comprising:

numbers of cutter bits and numbers of gabble roof-shaping cutter and compressor and propeller slider blades arranged alternately on an elongate motive rod in groups according to a predetermined number of stratums of the ground to be excavated to form a grouped rod digger, and comprising the following steps of:

digging a ditch in the ground along the length of the line to a predetermined depth by means of a ditching plough;

inserting a lower portion of the framework in the ditch;

positioning the grouped rod digger on the ground surface and the structure line;

excavating the ground to a predetermined depth and in an intended advancing direction by means of the grouped rod digger, intruding an excavated stratum ground earths separately into intended levels of the section, thereby mixing separately the excavated stratum ground earth in the intended levels of the section to form a correspondingly stratified soil filling structure of the excavated ground earths;

moving forcedly each stratum of the stratified soil filling by means of the grouped rod digger in a generally backward compressing direction, the compressing direction being opposite to the advancing direction toward and on a front working face of a compacted, stratified soil structure being formed in the slot section in the advancing direction to form the stratified compacted soil structure, and simultaneously forcing continuously the framework with the rod digger in the advancing direction to assist the chassis and the framework to advance the rod digger to form a further section of the trench slot excavation in the direction.

18. The underground continuous filling wall construction method according to claim 17 and utilizing the rod digger comprising a plurality of improving running filler material injection pipes, each injection pipe extending from the framework into the motive rod and having ends opening at predetermined ground stratums, and comprising the following steps of:

inserting a grouped compressor and propeller substantially similar in construction to the grouped rod digger and having a plurality of improving liquid injection pipes to jet each of the plurality of intended improving filler materials in each of the predetermined levels of the excavated slot section, thereby mixing each of the intended improving filler materials with the corresponding each of the stratums of the excavated ground earth filling in the intended levels of the excavated slot section and compressing the improved earth stratums to form a stratified, compacted and improved soil wall and stratum filling structure.

19. An underground continuous filling wall and stratum construction method, utilizing an apparatus comprising:

first and second paired traveling chassises each positioned on the ground and on an intended structure line and movable along the predetermined line in intended direction to produce the structure that extends in a generally downward direction in a section of a slot trench;

first and second supporting frameworks mounted on the corresponding first and second chassises and transportable in the horizontal directions to produce the structure;

a sweep-shaping motive rod extending between the frameworks;

a number of cutter bits and a number of cutter and compressor blades alternately arranged on the rod to form a compacted filling structure-forming sweep rod digger adapted to extend down into the ground from and between the frameworks;

a means supporting the first end of the sweep rod digger on the first framework for alternating downward and upward longitudinal reciprocation;

a means supporting the second end of the sweep digger on the second framework for the alternating downward and upward longitudinal reciprocation;

a first activating drive means on the first framework for producing the alternating downward and upward longitudinal reciprocation of the sweep rod digger and a second activating drive means on the second framework for producing the alternating downward and upward longitudinal reciprocation of the sweep rod digger;

a first means for measuring positions of the first supporting means and the first activating drive means in relation to the first framework and a second means for measuring positions of the second supporting means and the second activating drive means in relation to the second framework;

the method comprising:

positioning the first movable chassis and the second movable chassis of the apparatus for constructing the filling wall structure in a slot trench at an intended distance on the predetermined structure line between the first and second frameworks;

positioning the sweep able rod digger above the ground surface on the line;

operating the first activating drive means of the first chassis and the second activating drive means of the second chassis to advance the first chassis and the second chassis along the line to meet;

operating the first and second activating drive means to produce the alternating downward and upward longitudinal reciprocation of the sweep able rod digger;

inserting the sweep rod digger into the ground down to a predetermined depth and a predetermined length in the slot trench and excavating the ground in the downward direction by means of the sweep rod digger; while measuring positions of the sweep rod digger and the first supporting means and the first activating and drive means in relation to the first framework and positions of the sweep rod digger and the second supporting means and the second activating drive means in relation to the second framework; and determining when to operate multiple activating drive means of the first and second chassises, so that the sweep rod digger forms a section of the slot trench between the first and second frameworks and beneath of the length of the line and fills the excavated slot section with a predetermined filler material and compress a filling being formed in the slot section to form the compacted, filling wall structure.

20. The underground continuous, compacted filling wall structure construction method according to claim 19 and utilizing the sweep rod digger that is capable of constructing a horizontally extending, along the lengths of predetermined first and second structure lines, walls and stratum-shaped, compacted filling structure in a semi-cylindrical slot excavation, the sweep shield rod digger comprising a sweep motive rod, and the method further comprising the following steps of:

advancing the first and second chassises along the length of the intended first and second excavation lines in the intended first and second advancing directions;

inserting the sweep rod digger into the ground in the first and second directions and excavating the ground in the directions and filling a semi-cylindrical slot section being excavated, and compressing the face of the semi-cylindrical filling, while measuring positions of the first framework on the first line in relation to positions of the second framework on the second line and determining when to operate multiple activating means of the first and second chassises to effect further advancement of the semi-cylindrical walls and stratum structure in the intended direction.

* * * * *